US008215419B2

(12) United States Patent
Plunkett et al.

(10) Patent No.: US 8,215,419 B2
(45) Date of Patent: Jul. 10, 2012

(54) VARIABLE FREQUENCY CONTROL FOR DOWN HOLE DRILL AND METHOD

(75) Inventors: Timothy J. Plunkett, Roanoke, VA (US); Dale R. Wolfer, Salem, VA (US); Paul Campbell, Troutville, VA (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 367 days.

(21) Appl. No.: 12/436,261

(22) Filed: May 6, 2009

(65) Prior Publication Data

US 2010/0282509 A1 Nov. 11, 2010

(51) Int. Cl.
*E21B 4/14* (2006.01)

(52) U.S. Cl. ..... 175/296; 175/320; 173/208; 173/73

(58) Field of Classification Search ..... None
See application file for complete search history.

(56) References Cited

U.S. PATENT DOCUMENTS

| | | | | |
|---|---|---|---|---|
| 2,800,884 | A * | 7/1957 | Mori | 173/73 |
| 2,943,603 | A | 7/1960 | Bassinger | |
| 3,132,704 | A | 5/1964 | Bassinger et al. | |
| 3,768,576 | A | 10/1973 | Martini | |
| 3,995,700 | A * | 12/1976 | Mayer et al. | 173/2 |
| 4,062,411 | A * | 12/1977 | Adkins et al. | 173/115 |
| 4,246,973 | A | 1/1981 | Mayer | |
| 4,753,302 | A | 6/1988 | Gien et al. | |
| 5,085,284 | A | 2/1992 | Fu | |
| 5,301,761 | A | 4/1994 | Fu et al. | |
| 5,562,170 | A * | 10/1996 | Wolfer et al. | 175/296 |
| 5,749,677 | A * | 5/1998 | Grigoraschenko et al. | 405/184 |
| 6,367,565 | B1 * | 4/2002 | Hall | 175/50 |
| 6,883,618 | B1 * | 4/2005 | Pascale | 173/91 |

FOREIGN PATENT DOCUMENTS

| | | |
|---|---|---|
| EP | 0634559 | 1/1995 |
| GB | 2236782 | 4/1991 |
| WO | 99/19751 | 4/1999 |
| WO | 01/75268 | 10/2001 |
| WO | 2009/139705 A1 | 5/2009 |

OTHER PUBLICATIONS

International Search Report from PCT/US2010/033733 dated Nov. 19, 2010 (3 pages).
Written Opinion from PCT/US2010/033733 dated Nov. 19, 2010 (7 pages).

* cited by examiner

*Primary Examiner* — Kenneth L Thompson
*Assistant Examiner* — Ronald Runyan
(74) *Attorney, Agent, or Firm* — Michael Best & Friedrich LLP

(57) ABSTRACT

A variable frequency down hole drill, includes a drill bit, a reciprocating piston operable to deliver an impact load to the drill bit, and means for changing the frequency with which the piston delivers impact loading to the drill bit, also resulting in a change in overall power of the drill. The means for changing frequency and overall power may operate during continuous operation of the drill. The means for changing the frequency and overall power may include a valve for selectively changing the effective volume of a drive or return chamber, an actuator for changing the timing of placing the drive or return chamber in communication with exhaust, or a system for changing the frequency in response to sensing an predetermined operating parameter of the drill, such as pressure or piston position.

19 Claims, 23 Drawing Sheets

VARIABLE FREQUENCY CONTROL FOR DOWN HOLE DRILL AND METHOD

BACKGROUND

The present invention relates to a down hole drill having a mechanism for changing the frequency of drill operation. The invention includes several embodiments demonstrating various means and methods for changing frequency. The present invention may be used to change frequency of drill operation during continuous operation of the drill, without having to remove the drill from the hole in which it is operating and without having to cease the drilling operation.

SUMMARY

In one embodiment, the invention provides a variable frequency down hole drill, comprising: a supply of motive fluid; an exhaust structure communicating with the atmosphere; a drill bit; a reciprocating piston supported for reciprocation with respect to the drill bit; a drive chamber above the piston; a return chamber below the piston; means for driving reciprocation of the piston by alternatingly placing the drive chamber in communication with the supply of motive fluid and the return chamber in communication with the exhaust structure in a first instance and placing the drive chamber in communication with the exhaust structure and the return chamber in communication with the supply of motive fluid in a second instance; means for generating a command signal; and means for changing, in response to the command signal, the frequency with which the piston delivers impact loading to the drill bit.

In some embodiments, the means for changing frequency includes means for changing frequency during continuous operation of the drill. In some embodiments, the means for changing the frequency includes a supplemental volume chamber and a valve operable between an open position in which the valve places the drive chamber in communication with the supplemental volume chamber, and a closed condition in which the valve cuts off communication between the supplemental volume chamber and the drive chamber. In some embodiments, the means for changing the frequency includes a supplemental volume chamber and a valve operable between an open position in which the valve places the return chamber in communication with the supplemental volume chamber, and a closed condition in which the valve cuts off communication between the supplemental volume chamber and the return chamber. In some embodiments, the means for changing the frequency includes means for changing the timing of placing the drive chamber in communication with the exhaust structure. In some embodiments, the means for changing the frequency includes means for changing the timing of placing the drive chamber in communication with the supply of motive fluid. In some embodiments, the means for changing the frequency includes means for changing the timing of placing the return chamber in communication with the exhaust structure. In some embodiments, the means for changing the frequency includes means for changing the timing of placing the return chamber in communication with the supply of motive fluid. In some embodiments, the variable frequency down hole drill further comprises a control system for sensing an operating parameter of the drill and actuating the means for changing the frequency in response to sensing a predetermined operating parameter. In some embodiments, the control system includes a controller and a sensor sensing one of pressure and piston position. In some embodiments, the control system includes a controller, a control valve, and a main valve; wherein the main valve opens in response to a lift off pressure being achieved in the drive chamber to place the drive chamber in communication with the supply of motive fluid; and wherein the controller opens the control valve to generate a control signal from the control valve to the main valve to delay opening of the main valve after lift off pressure is achieved, to alter the timing of opening of the main valve.

The invention also provides a variable frequency down hole drill for use with a supply of motive fluid, the variable frequency down hole drill comprising: an exhaust structure communicating with the atmosphere; a drill bit; a reciprocating piston supported for reciprocation with respect to the drill bit; a drive chamber above the piston; a return chamber below the piston; a valve adapted to place the drive chamber and return chamber in alternating communication with the supply of motive fluid and exhaust structure to drive reciprocation of the piston; and a mechanism for changing the timing of operation of the valve in response to a command signal, to change the frequency with which the piston delivers impact loading to the drill bit.

In some embodiments, the mechanism for changing timing of operation of the valve is operable during continuous operation of the drill. In some embodiments, the mechanism for changing timing of operation of the valve includes a second valve operable to open and close communication between one of the drive and return chambers and a supplemental volume chamber. In some embodiments, the mechanism for changing timing of operation of the valve includes a mechanism for changing the timing of placing at least one of the drive chamber and return chamber in communication with at least one of the supply of motive fluid and the exhaust structure. In some embodiments, the mechanism for changing timing of operation of the valve includes a sensor monitoring an operating parameter of the drill and generating the command signal in response to sensing a predetermined value for the operating parameter. In some embodiments, the mechanism for changing timing of operation of the valve includes a controller, a control valve, and a main valve; wherein the main valve opens in response to a lift off pressure being achieved in the drive chamber to place the drive chamber in communication with the supply of motive fluid; and wherein the controller opens the control valve to generate a control signal from the control valve to the main valve to delay opening of the main valve after lift off pressure is achieved, to alter the timing of opening of the main valve.

The invention also provides a method for operating a down hole drill at variable speeds, the method comprising: (a) driving reciprocation of a piston by alternatingly establishing and cutting off communication between a supply of motive fluid and exhaust and opposite ends of the piston; (b) impacting a drill bit with the piston once per cycle of operation of the piston; and (c) during continuous operation of the drill, changing a timing at which communication between at least one of the opposite ends of the piston and at least one of the supply of motive fluid and the exhaust is established and cut off.

In some embodiments, step (c) includes sensing an operating parameter of the drill during continuous operation of the drill, automatically generating a command signal in response to the operating parameter meeting a predetermined value, and, in response to generation of the command signal, actuating a mechanism for altering the timing of communication between at least one of the opposite ends of the piston and at least one of the supply of motive fluid and exhaust.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
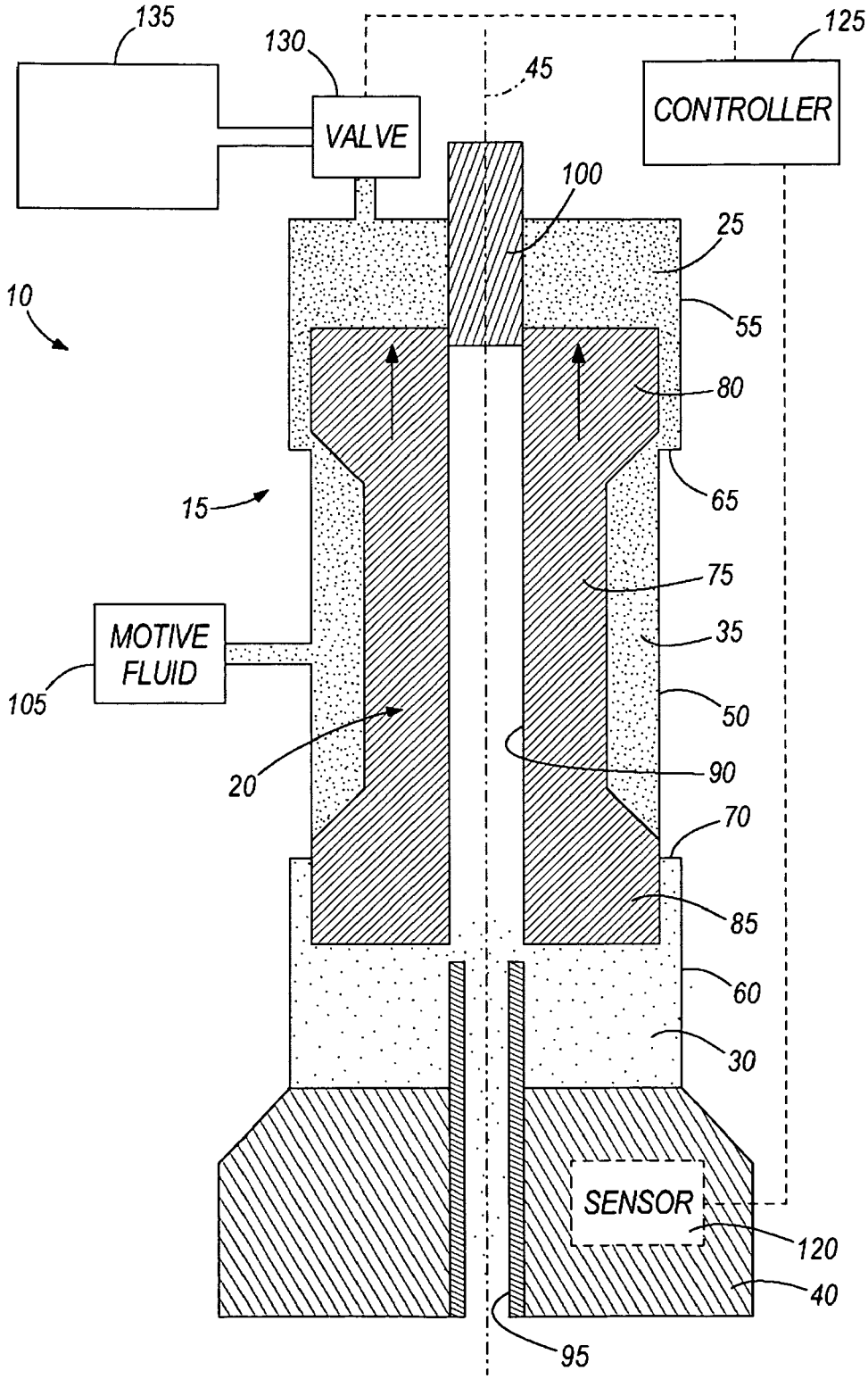
FIGS. 1-6 are a schematic illustration of a first embodiment of the invention operating at a first frequency.

FIG. 1 schematically illustrates a down hole drill assembly 10 including a housing 15, a piston 20, a drive chamber 25 above the piston 20, a return chamber 30 below the piston 20, a supply chamber 35 between the drive chamber 25 and return chamber 30, and a drill bit 40. The piston 20 reciprocates in the housing 15 to apply impact loading to the drill bit 40.

The housing 15 defines a longitudinal axis 45 that is generally vertical in the drill's ordinary operating orientation. In the schematic drawings, the housing 15 includes a supply portion 50 having a first inner diameter, a drive side portion 55 having a second inner diameter larger than the first inner diameter, and a return side portion 60 having a third inner diameter that is also larger than the first inner diameter. The third inner diameter is illustrated as about equal to the second inner diameter, but in reality the second and third inner diameters may be different. Further, in some embodiments, the first inner diameter can actually be stepped and have multiple diameters. The transition from the supply portion 50 to the drive side portion 55 defines a drive step 65, and the transition from the supply portion 50 to the return side portion 60 defines a return step 70.

The piston 20 includes a middle portion 75 having a first outer diameter, a top portion 80, and a bottom portion 85. The top portion 80 and bottom portion 85 have outer diameters larger than the first outer diameter. The schematic drawings illustrate the top portion 80 and bottom portion 85 as having equal outer diameters, but in reality the top portion 80 and bottom portion 85 may have different outer diameters. A central bore 90 extends through the piston 20 in the longitudinal direction.

An exhaust conduit 95 communicates through the drill bit 40 to atmospheric pressure. Motive fluid flowing out of the exhaust conduit 95 flushes drillings and other debris around the drill bit 40 and up the hole in which the drill is operating. A plug 100 extends into the drive chamber 25. In other embodiments, the plug 100 may include a motive supply conduit for the supply of motive fluid to the supply chamber 35, but functionally, such supply conduit includes an element that selectively extends into the central bore 90 as the plug 100 does in the schematically illustrated embodiment. The exhaust conduit 95 and plug 100 have outer diameters about equal to the diameter of the central bore 90 and are aligned with the central bore 90.

Reciprocation of the piston 20 is driven by motive fluid (e.g., a compressible fluid such as air or an incompressible fluid such as hydraulic oil) that is supplied to the supply portion 50 of the housing 15 from a source of motive fluid 105. Although the source of motive fluid 105 is shown communicating directly with the supply chamber 35 through the side of the housing 15, in most commercial embodiments the source of motive fluid 105 supplies motive fluid to the supply chamber 35 through a drill pipe or drill string that connects to the top of the drill assembly 10 (i.e., communicating with the supply conduit/plug 100 discussed above and ported to the supply chamber 35). Although in the schematically illustrated embodiment, the motive fluid flows into a supply chamber 35 that is physically between the drive chamber 25 and return chamber 30, the scope of the invention is not limited by such physical arrangement. There are many other porting and air logic arrangements in which the motive fluid can be alternated between the drive chamber 25 and return chamber 30 to achieve the functionality described below.

With reference to FIG. 1, when the top portion 80 of the piston 20 clears the drive step 65, the supply chamber 35 is placed in communication with the drive chamber 25. Substantially simultaneously with the top portion 80 of the piston 20 clearing the drive step 65, several other communications are opened and closed: the bottom portion 85 of the piston 20 registers with the return step 70 to cut off communication between the return chamber 30 and the supply chamber 35; the exhaust conduit 95 is removed from the central bore 90 to open communication between the return chamber 30 and the exhaust; and the plug 100 is received within the central bore 90 to cut off communication between the drive chamber 25 and the central bore 90. In other embodiments, the communications mentioned above may occur in staggered progression rather than substantially simultaneously. For example, the plug 100 may be received in the central bore 90 prior to the exhaust conduit 95 being removed from the central bore 90, and prior to the top portion 80 of the piston 20 clearing the drive step 65.

Figure 2:
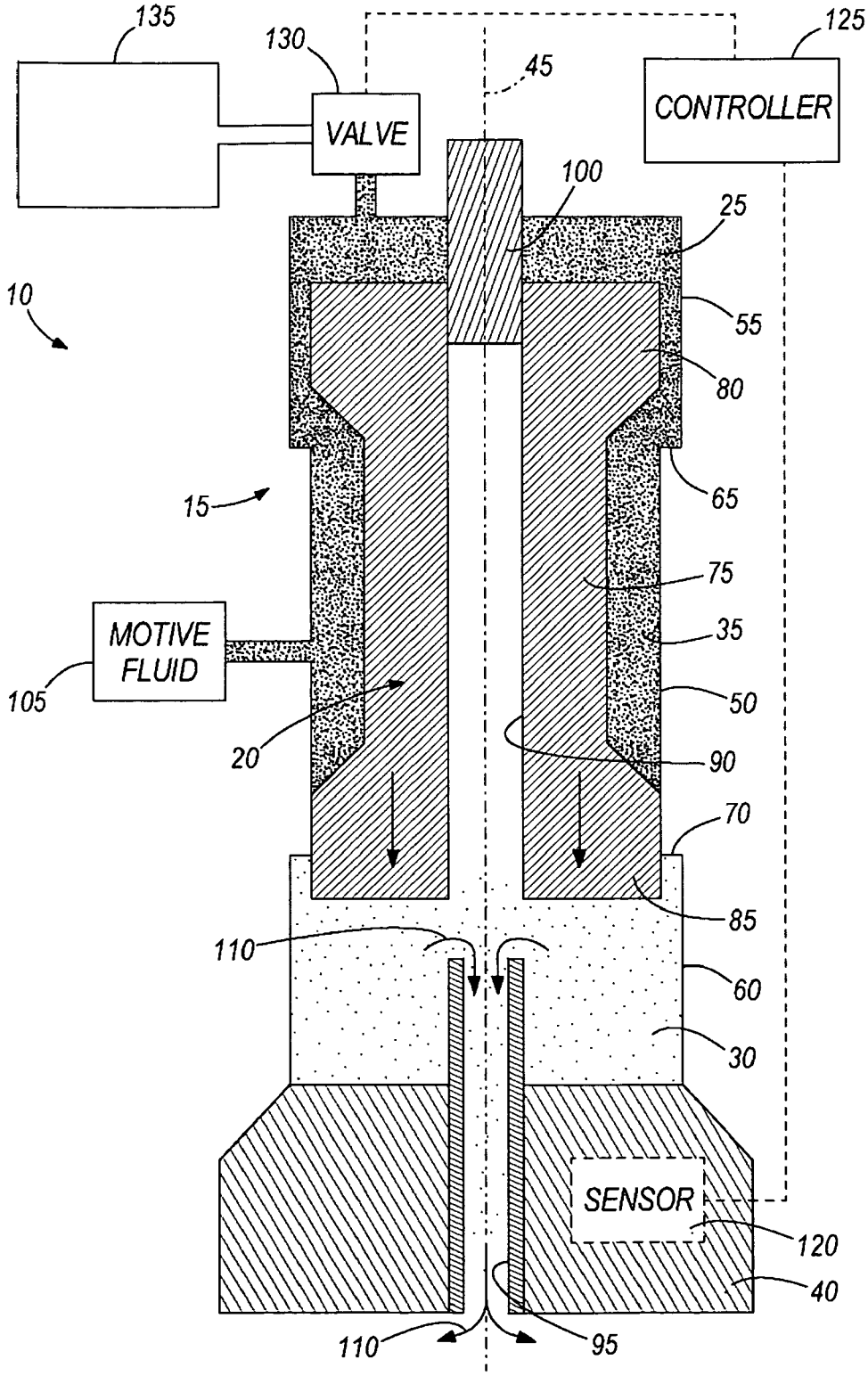

With reference to FIG. 2, as the piston 20 continues its rise, pressure rapidly builds up in the drive chamber 25 due to motive fluid rushing into the drive chamber 25 simultaneously with the shrinking volume of the drive chamber 25 due to the upward movement of the piston 20. In the drawings, the density of stippling is roughly proportional to pressure. The rise in pressure arrests upward movement of the piston 20 and drives the piston 20 down toward impact with the drill bit 40 again. The pressure in the drive chamber 25 at which upward movement of the piston 20 is arrested is referred to throughout this specification as the "critical pressure." Initial downward movement of the piston 20 is not significantly resisted because residual motive fluid in the return chamber 30 is exhausted through the exhaust conduit 95 (as illustrated with return exhaust arrows 110).

Figure 3:
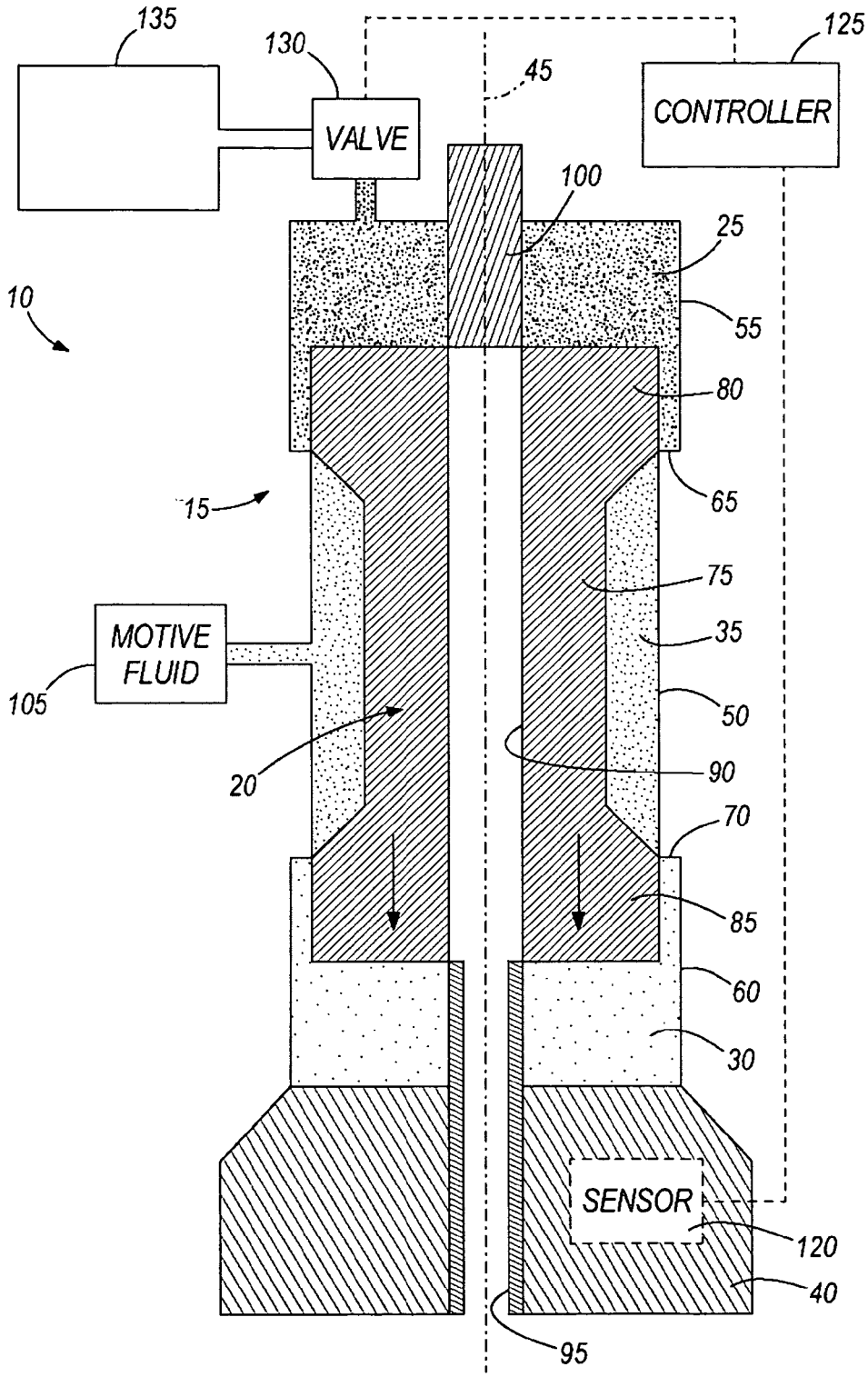

In FIG. 3, the piston 20 is in the middle of its stroke, and communication between the supply of motive fluid is momentarily cut off from both the drive chamber 25 and return chamber 30.

Figure 4:
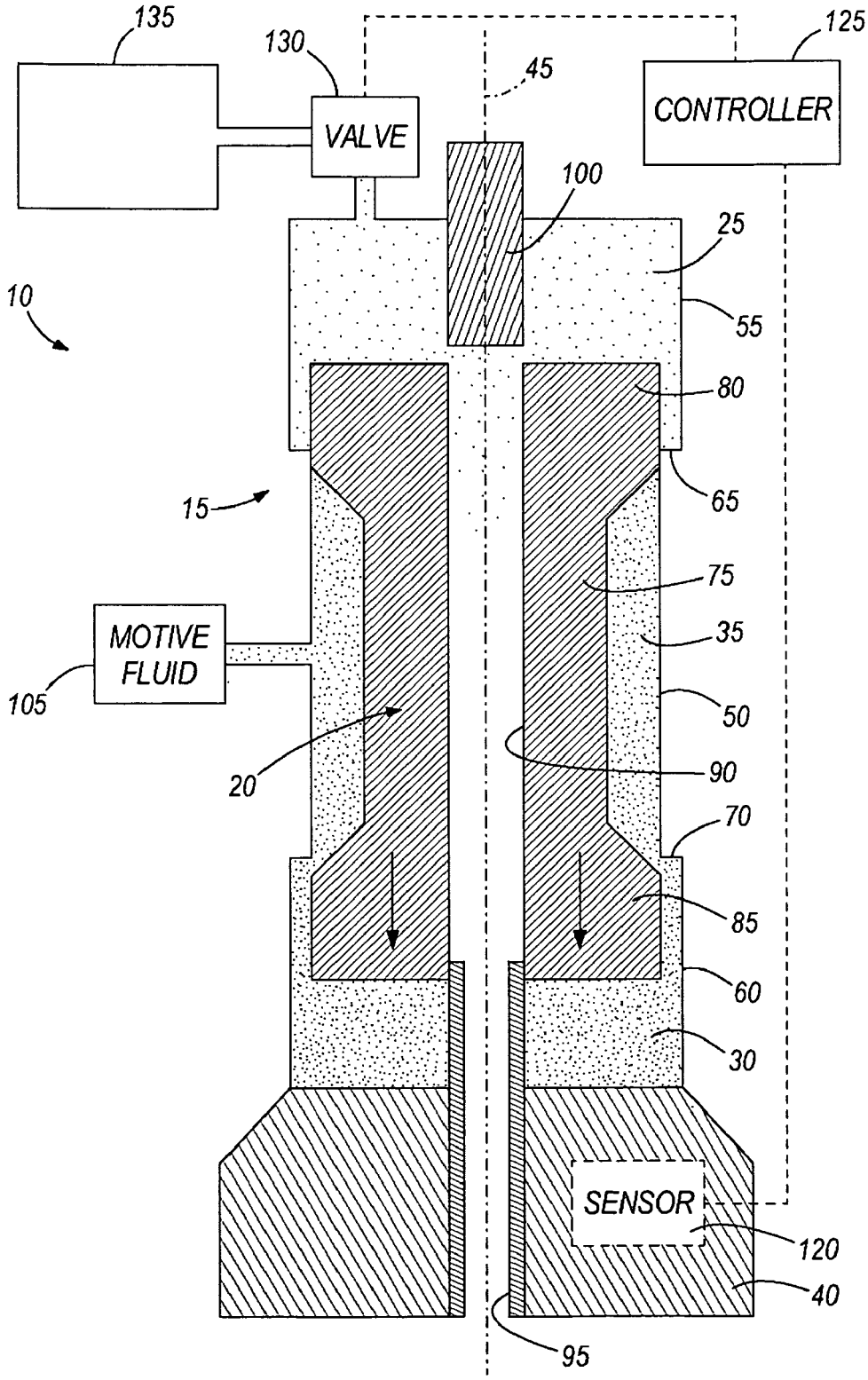

In FIG. 4, as the bottom portion 85 of the piston 20 clears the return step 70, the supply chamber 35 is placed in communication with the return chamber 30. Substantially simultaneously with the bottom portion 85 of the piston 20 clearing the return step 70, several other communications are opened and closed: the top portion 80 of the piston 20 registers with the drive step 65 to cut off communication between the drive chamber 25 and the supply chamber 35; the exhaust conduit 95 is received within the central bore 90 to cut off communication between the return chamber 30 and the exhaust; and the plug 100 is removed from the central bore 90 to open communication between the drive chamber 25 and exhaust through the central bore 90 and exhaust conduit 95. As discussed above with respect to the upward stroke of the piston 20, the timing of these communications can be staggered and are not necessarily simultaneous in all embodiments. Because the interplay between the piston 20, drive step 65, return step 70, central bore 90, exhaust conduit 95, and plug 100 control the communication of the drive chamber 25 and return chamber 30 with the supply of motive fluid 105 and with exhaust, the assembly may be referred to collectively as a valve.

Figure 5:
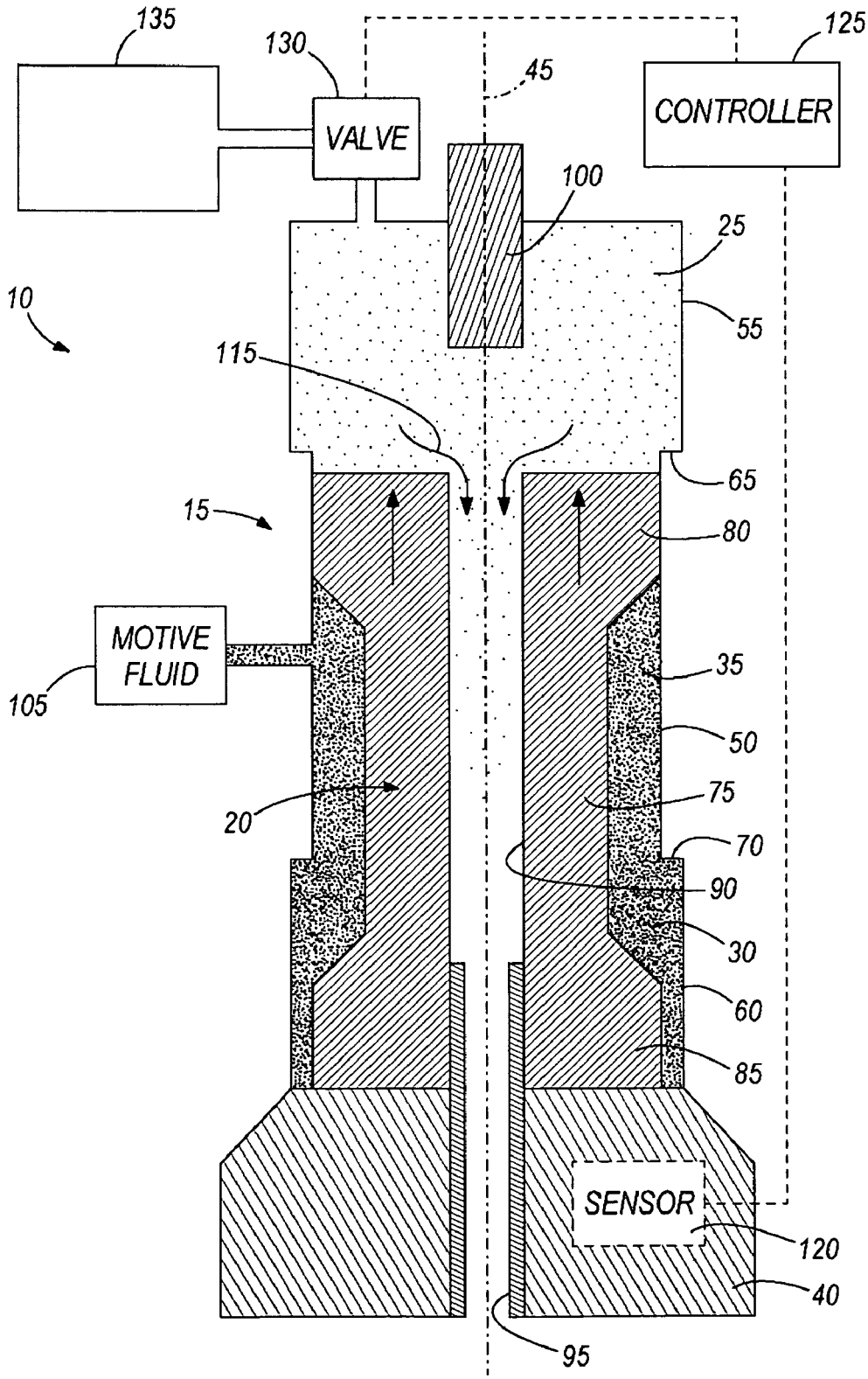
Figure 6:
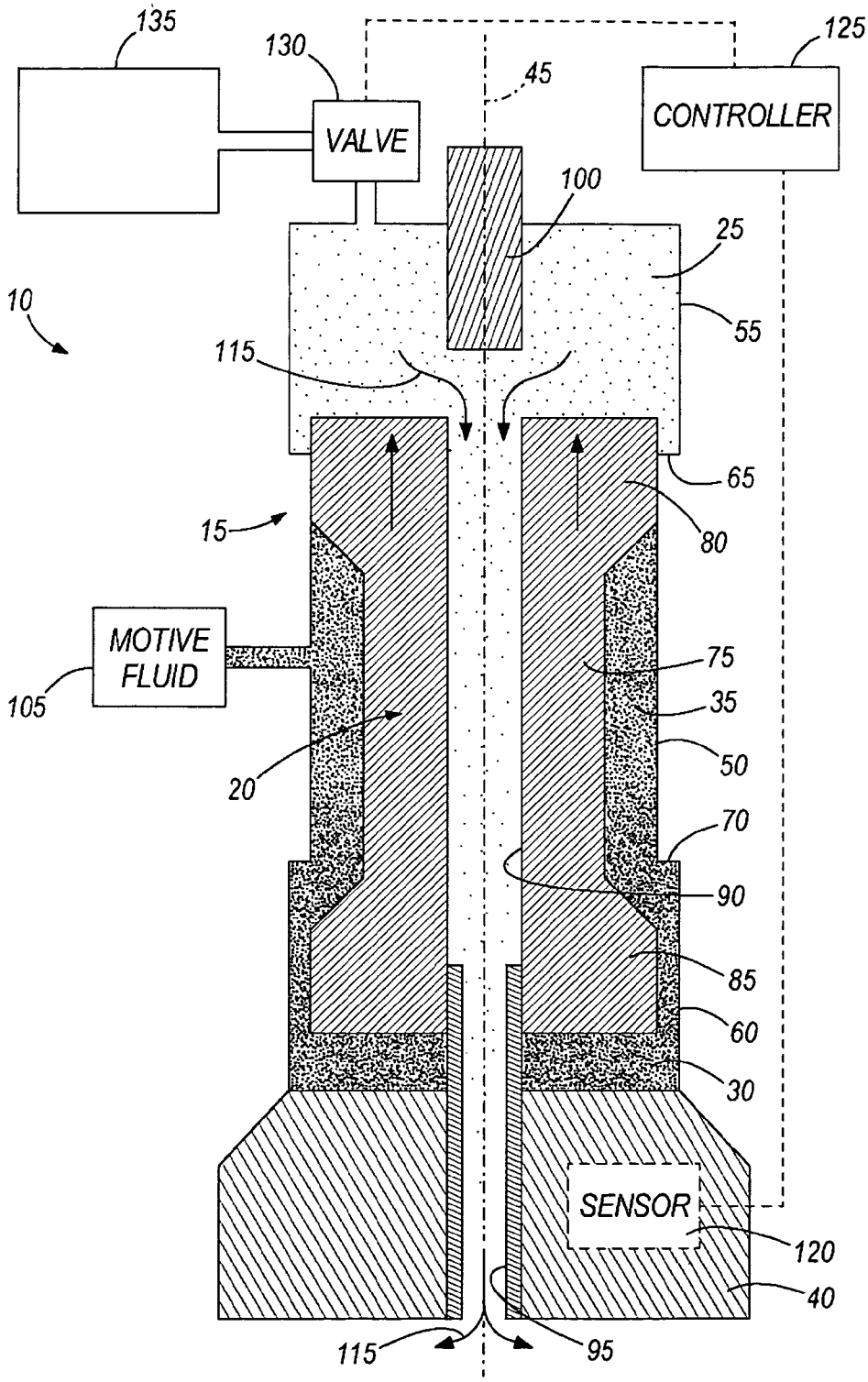

Referring now to FIGS. 5 and 6, motive fluid rushes into the return chamber 30 as motive fluid rushes out of the drive chamber 25 and is exhausted through the drill bit 40 to the atmosphere (as illustrated with drive exhaust arrows 115). Pressure rapidly builds up in the return chamber 30 as its volume shrinks due to downward movement of the piston 20, but there is sufficient downward momentum of the piston 20 to enable it to strike the drill bit 40, which transmits the impact loading to the rock or other substrate being drilled. As pressure rapidly builds and is assisted by the rebound of the piston 20 off the drill bit 40, the piston 20 is driven up. Initial upward movement of the piston 20 is not significantly resisted by pressure in the drive chamber 25 because any motive fluid in the drive chamber 25 is exhausted through the central bore 90 and exhaust conduit 95 (see drive exhaust arrows 115).

In FIGS. 1-6, described above, the drill operates at a first frequency. For the purposes of this disclosure, the phrase "frequency of the drill" and similar phrases refer to the frequency with which the piston 20 imparts an impact load to the drill bit 40. There are several ways to change the frequency of the drill. The frequency of impact of the piston 20 on the drill bit 40 has an inverse relationship with the stroke length of the piston 20, such that an increase in stroke length results in a decrease in frequency of the drill. The stroke length of the piston 20 is set in part by the volume of the drive chamber 25. The piston 20 stops rising when the force on the piston 20 arising from pressure in the drive chamber 25 is sufficient to overcome the upward momentum of the piston 20. Pressure is a function of volume when all other factors (such as temperature) remain substantially constant. Therefore, if the volume of the drive chamber 25 is expanded, the piston 20 is permitted to rise higher before the pressure reaches a level sufficient to arrest the piston 20's upward momentum. As a result, with other factors substantially constant, the frequency of the drill will decrease as the volume of the drive chamber 25 is increased.

Frequency of the drill can also correlate to the impact load delivered by the piston 20 to the bit 40 in each cycle. Generally speaking, with all other factors (e.g., volumes and supply pressure of motive fluid) substantially constant, a drill operating at higher frequency will deliver lower impact loading to the bit in each cycle and a drill operating at a lower frequency will deliver higher impact loading per cycle. Impact loading per cycle in combination with the frequency of the operation determines the overall power of the hammer. Typically, a high-frequency, low impact load per cycle mode of operation will result in lower overall hammer power and a low-frequency, high impact load per cycle mode of operation will result in higher overall hammer power. The present invention permits a hammer to operate in the former mode (high-frequency, low impact load) when drilling relatively soft substrates and in the latter mode (low-frequency, high impact load) when drilling relatively hard substrates. Additionally, it may be possible through the present invention to reduce the risk of bit breakage by operating at an overall drill power that is appropriate for the substrate being drilled and the weight on bit conditions in the hole. In view of the interplay between drill frequency and overall power, it will be understood that references to changes in drill frequency implicitly include resulting changes in drill power.

Impact of the piston 20 on the drill bit 40 generates seismic waves through the ground or vibrations through the drill and drill pipe, which may be read at the surface with geophones or other sensors, or by accelerometers or other frequency or velocity meters or monitors on the drilling assembly. One may wish to change the frequency of the drill to convey information to the surface. Sequences of change in frequency may be used as a code, and the sequences can be decoded at the surface to learn about operating conditions at the bottom of the hole being drilled. If the frequency of the drill can be changed during operation (e.g., "on the fly"), information may be transmitted to the surface without having to stop the drilling operation. The present invention permits transmittal of information during drill operation, with the only change in operation being a change in frequency and not a complete cessation. Terms like "during operation" are therefore intended to mean that a change in frequency can occur without removal of the drilling assembly from the hole so that manual adjustments can be made to the drilling assembly to change the frequency of the drill.

Figure 7:
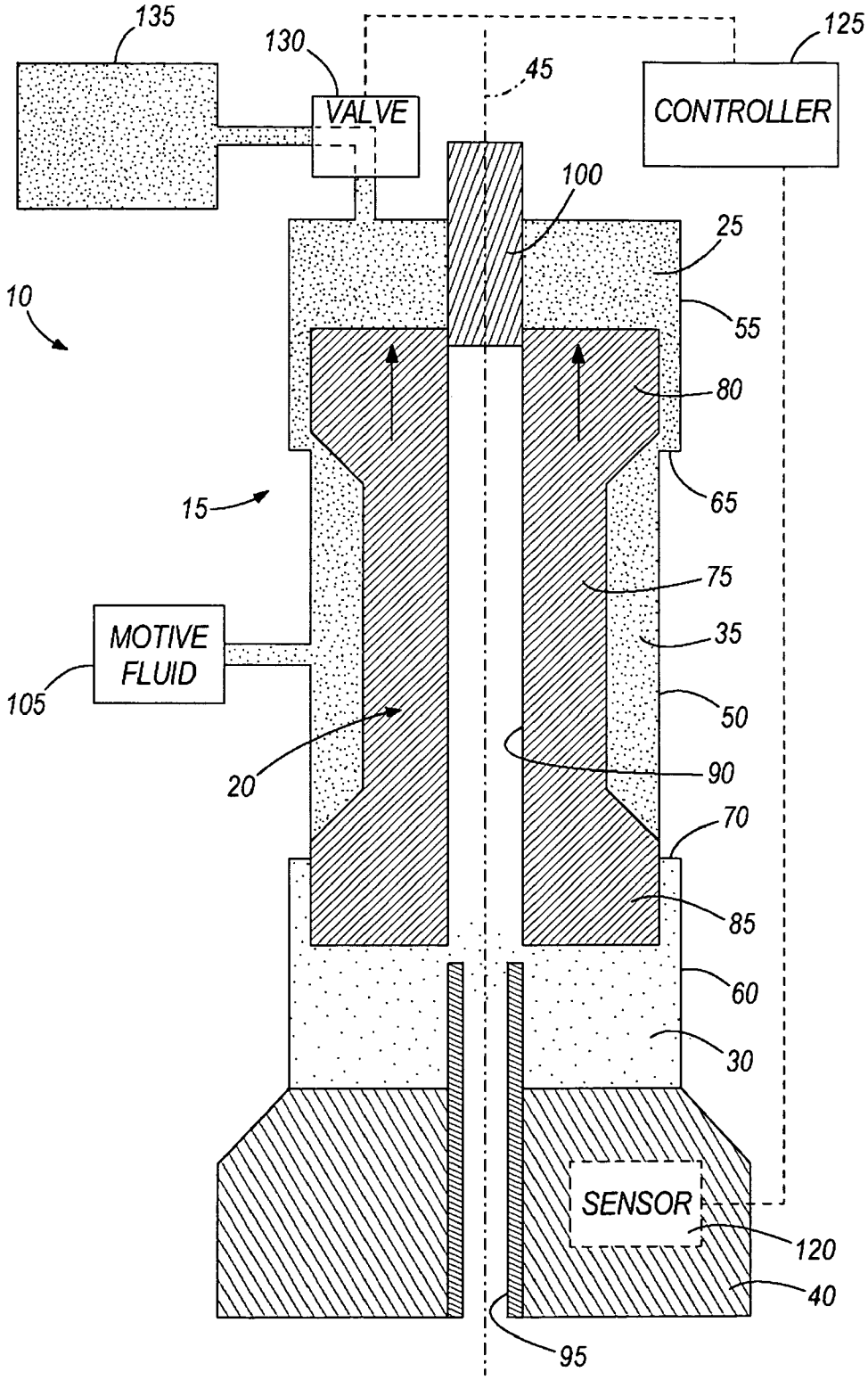
FIGS. 7-8 are a schematic illustration of the first embodiment operating at a second frequency.
Figure 8:
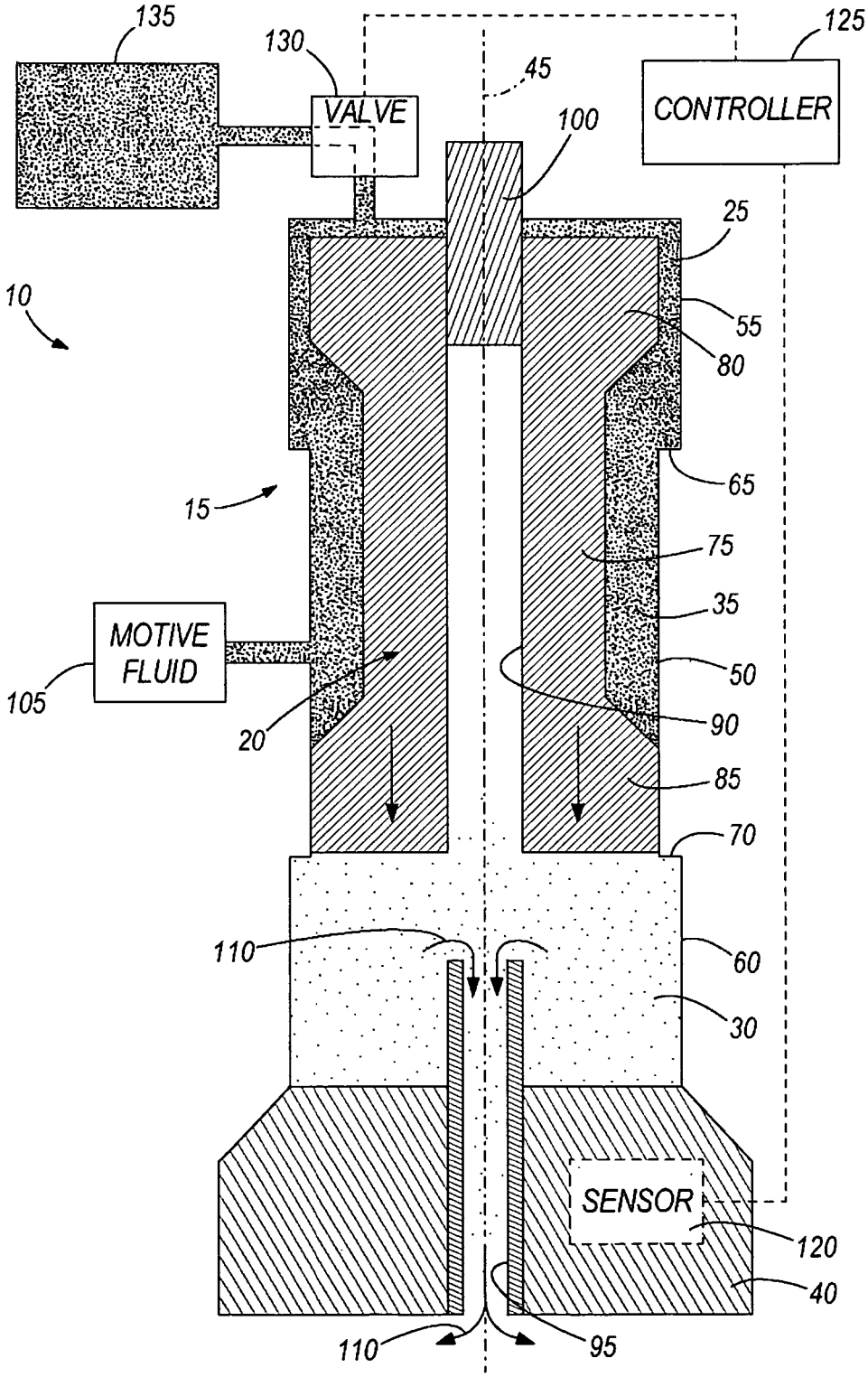
Figure 9:
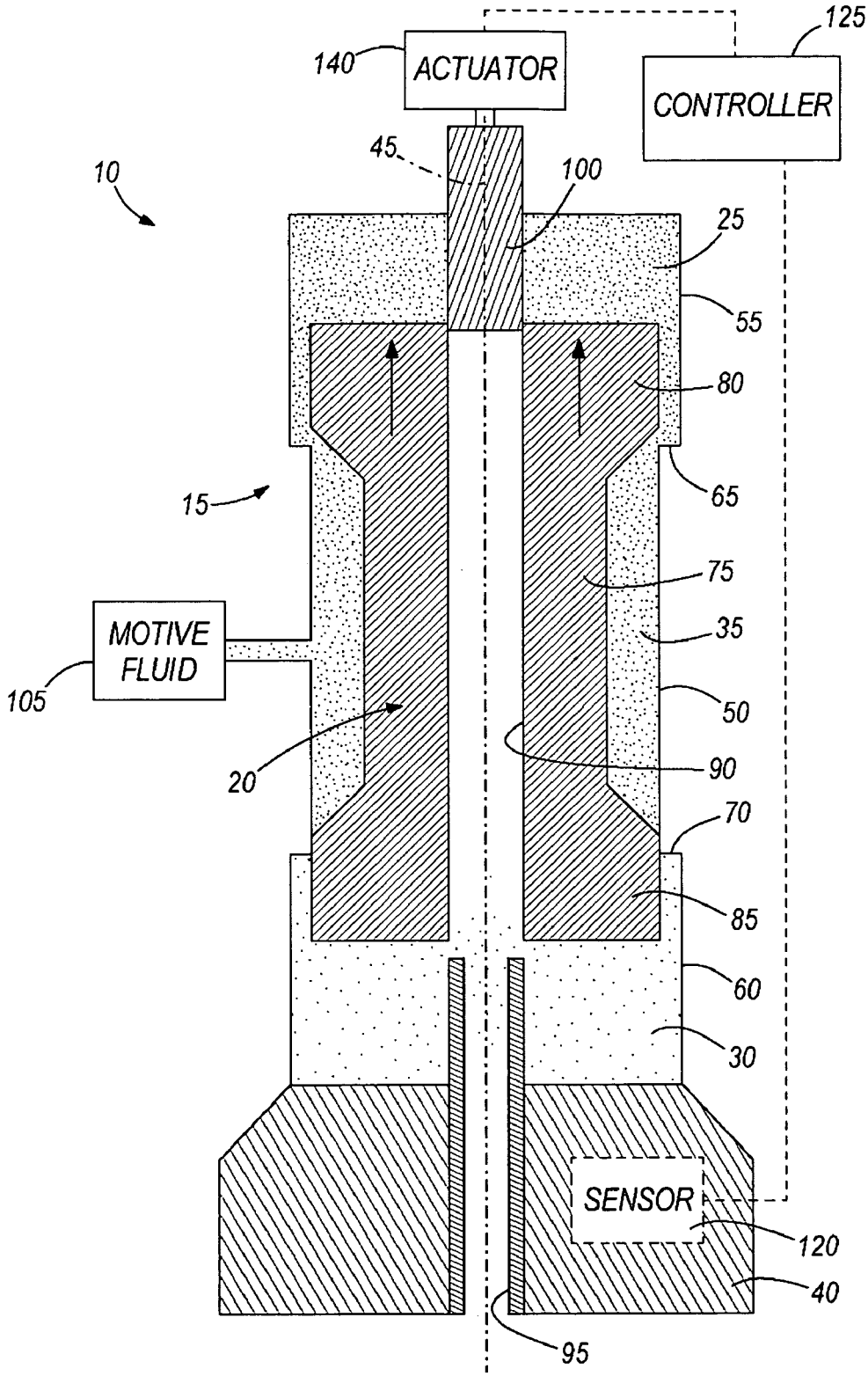
FIGS. 9-10 are a schematic illustration of a second embodiment of the invention operating at a first frequency.
Figure 10:
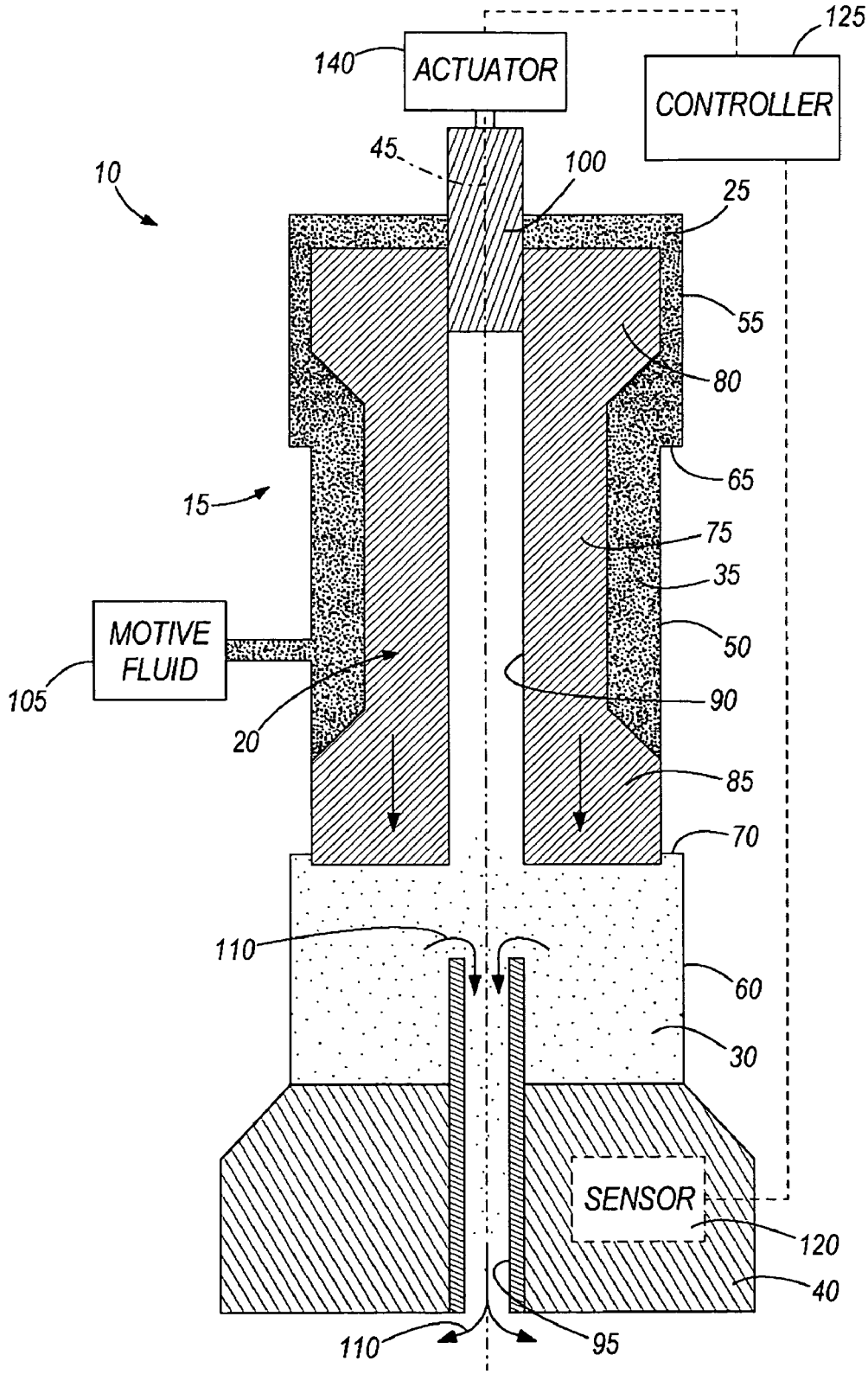

FIGS. 7 and 8 illustrate a first mechanism for selectively increasing the volume of the drive chamber 25 to consequently increase stroke length and decrease frequency of the drill. The drill is equipped with sensors 120 to sense one or more potentially relevant environmental factors such as temperature, radiation, magnetic field, earth magnetic field vector, direction of gravity, and weight on bit. The sensor 120 in the illustrated embodiment is on the drill bit 40, but other sensors 120 may be positioned elsewhere in the drilling assembly, depending on what the sensors 120 are designed to sense. These sensors 120 send or generate (via wire or wireless means) command signals to a controller 125 which may physically reside on the drill assembly 10. The controller 125 communicates with and controls operation of a valve 130, which is also on the drilling assembly. In other embodiments, the controller 125 may be part of a control assembly at the surface, which receives information from the sensors 120 through any suitable means, and which is manually operable by an operator at the surface.

The valve 130 is operable between an open position in which the valve 130 places the drive chamber 25 in communication with a supplemental volume chamber 135, and a closed condition in which the valve 130 cuts off communication between the supplemental volume chamber 135 and the drive chamber 25. When the valve 130 is in the closed condition, the drive chamber 25 has a first volume, and when the valve 130 is in the open condition, the drive chamber has a second effective volume (larger than the first volume) which includes the original volume of the chamber 25 plus the volume of the supplemental volume chamber 135.

With specific reference to FIGS. 7 and 8, when the controller 125 receives a command signal from the sensor 120 that requires the controller 125 to send information to the surface, the controller 125 automatically changes frequency of the drill in a predetermined sequence by opening and closing the valve 130. In other embodiments, an operator at the surface may actuate the controller 125 upon receiving the command signal from the sensor 120. With the valve 130 closed, the drill operates as described above with respect to FIGS. 1-6, and at a first frequency. With the valve 130 open, the effective volume of the drive chamber 25 increases to the original volume plus the supplemental volume 135. As a result, the piston 20 rises higher before its upward momentum is arrested (i.e., before reaching critical pressure; see FIG. 8), which increases the stroke length of the piston 20 and decreases the frequency of the drill.

Figure 11:
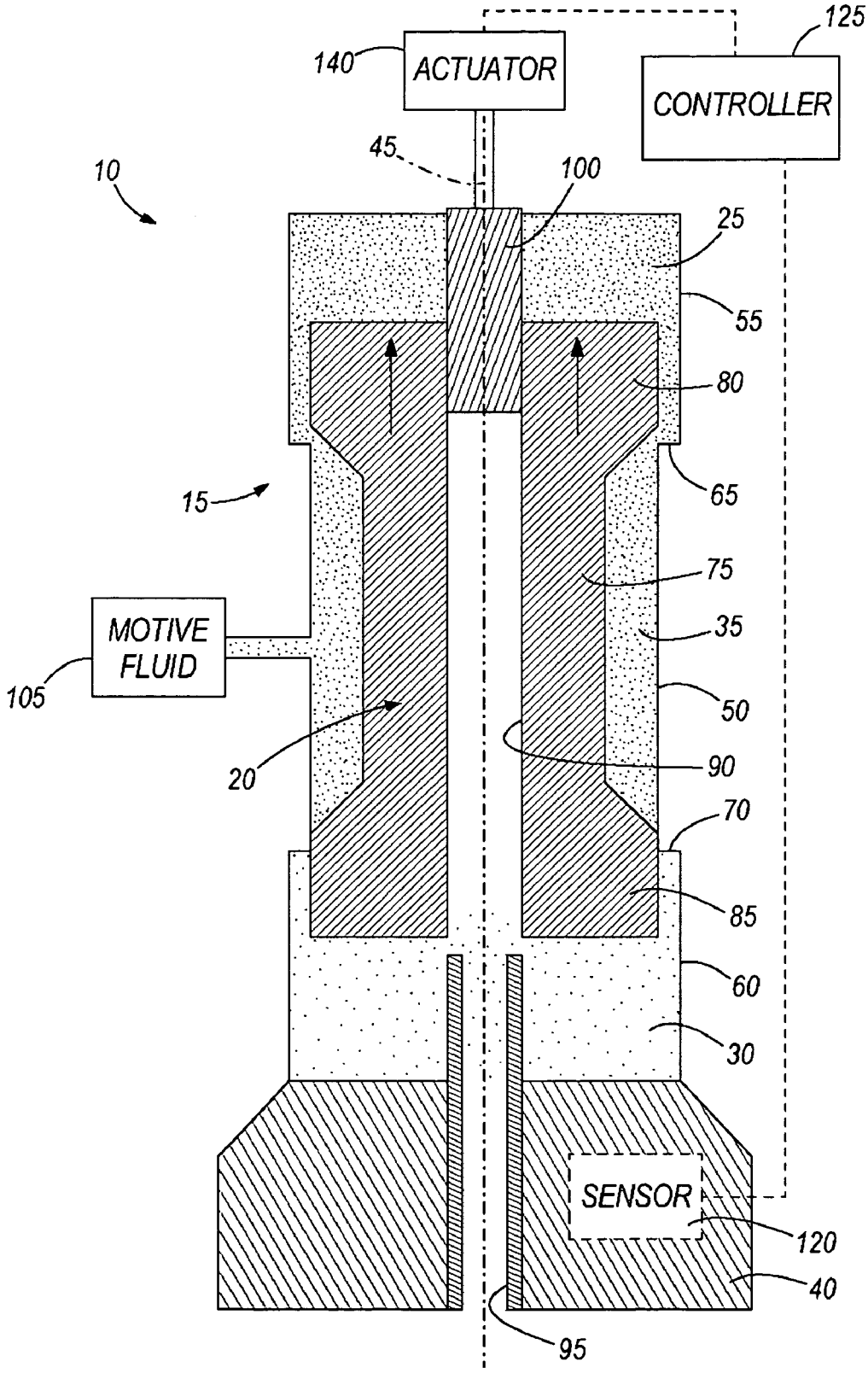
FIGS. 11-12 are a schematic illustration of the second embodiment operating at a second frequency.
Figure 12:
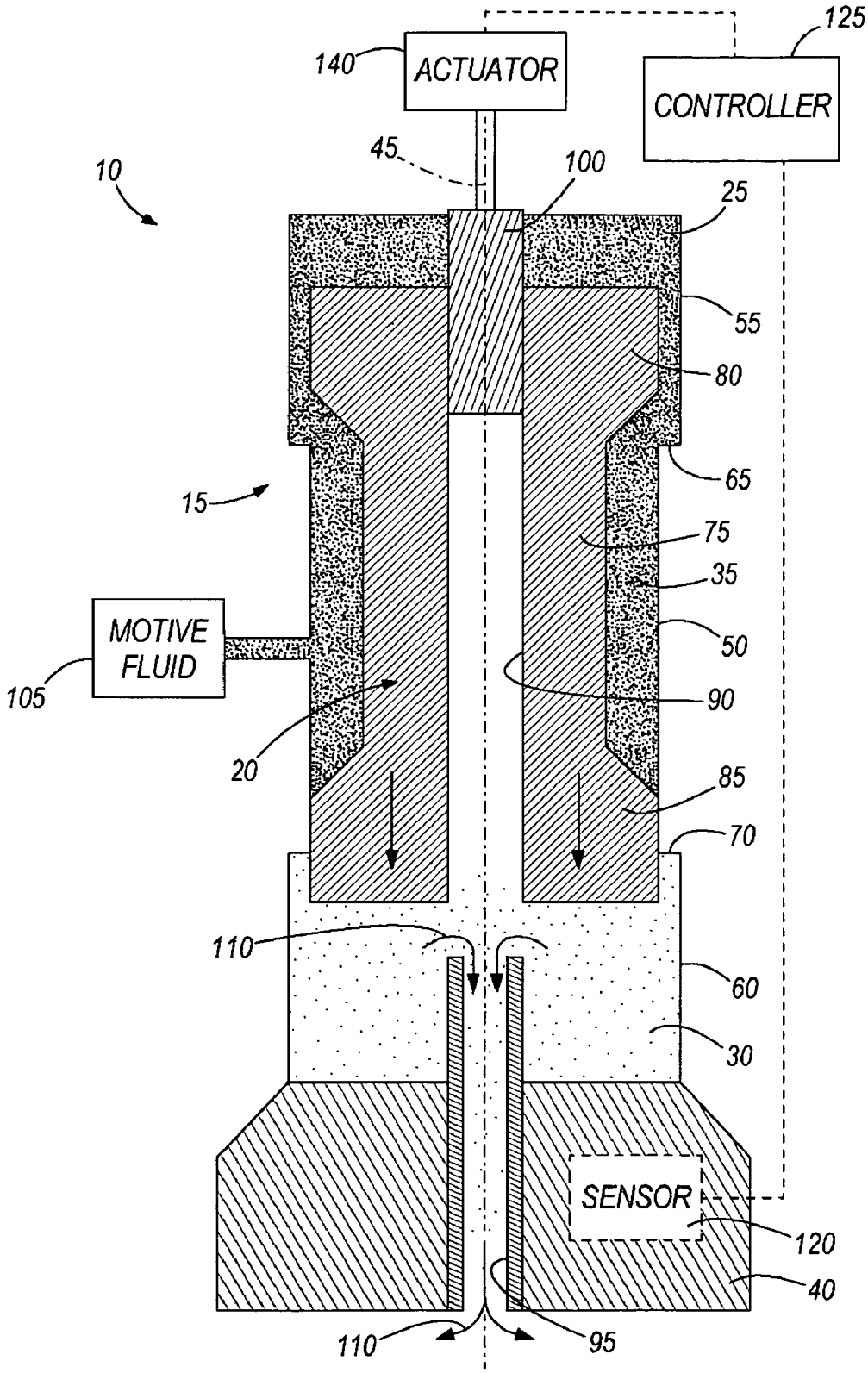

FIGS. 9-12 illustrate another arrangement for changing the frequency of the drill. In this arrangement, the controller 125 operates an actuator 140 connected to the plug 100. The controller 125 changes the frequency of the drill by moving the plug 100 longitudinally or axially (i.e., along axis 45) to change the timing of the plug 100 closing and opening communication between the drive chamber 25 and central bore 90. With the actuator 140 in a first condition (e.g., at-rest or retracted) illustrated in FIGS. 9 and 10, the piston 20 rises to a first height before the critical pressure is reached in the drive chamber 25 to arrest upward momentum of the piston 20. In FIGS. 11 and 12, the controller 125 has received a signal from the sensor 120 and has actuated the actuator 140 into a second condition (e.g., extended), such that the plug 100 is moved downward along the longitudinal axis 45 toward the drill bit 40. This results in communication between the drive chamber 25 and central bore 90 being cut off earlier in the upward stroke of the piston 20, which results in pressure building up faster in the drive chamber 25 such that the critical pressure is achieved earlier (i.e., at a lower piston 20 height) than in FIGS. 9 and 10. As a result, piston 20 upward momentum is arrested earlier (stroke length is decreased) and the frequency of the drill is increased. Of course, in other embodiments, the actuator 140 could be configured to normally operate in the extended condition illustrated in FIGS. 11 and 12, and be selectively actuated into the retracted condition illustrated in FIGS. 9 and 10 to increase stroke length and decrease frequency of the drill.

FIGS. 13-17 illustrate another alternative control arrangement 210 that includes a control valve 215 and a main valve 220. In this embodiment, the source of motive fluid 105 communicates with the main valve 220 through a primary conduit 225, and communicates with the control valve 215 through a secondary conduit 230. A control conduit 235 communicates between the control valve 215 and the main valve 220, and a supplemental supply conduit 240 communicates between the main valve 220 and the drive chamber 25. Supply pressure acting on the main valve 220 through the control conduit 235 may be referred to as a pilot signal or control signal. The controller 125 electronically (via wire or wireless means) opens and closes the control valve 215, to turn the control signal on and off, respectively. The control valve 215 may in some embodiments include a suitable electromechanical device, such as a solenoid, that converts the electronic control signals from the controller 125 into turning the control signal on and off.

The main valve 220 may be configured as a differential valve, with pressure from the supplemental supply conduit 240 acting on a first surface area 250 of the valve 220, pressure from the primary conduit 225 acting on a second surface area 255 (facing generally opposite the first surface area 250), and the control signal from the control conduit 235 acting on a third surface area 260 (also facing generally opposite the first surface area 250). In one arrangement of surface areas, the force generated by the critical pressure in the drive chamber 25 acting on the first surface area 250 is insufficient to overcome the combined forces of the supply pressure acting on the second and third surface areas 255, 260, and the main valve 220 remains closed as long as the control signal is provided. When the control signal is turned off, however, the force of pressure in the drive chamber 25 acting on the first surface area 250 overcomes the force of supply pressure on the second surface area 255 prior to the pressure in the drive chamber 25 reaching the critical pressure, which causes the main valve 220 to open.

The pressure in the drive chamber 25 necessary to open the main valve 220 may be referred to as "lift off pressure," and is proportional to the size of the second surface area 255 for a given first surface area 250. In some embodiments, it is desirable to make the second surface area 255 small such that lift off pressure is quickly reached in the absence of the control signal acting on the third surface area 260. Once lift off pressure is achieved and the main valve 220 opens, motive fluid floods into the drive chamber 25 through the main valve 220 and supplemental supply conduit 240.

Figure 13:
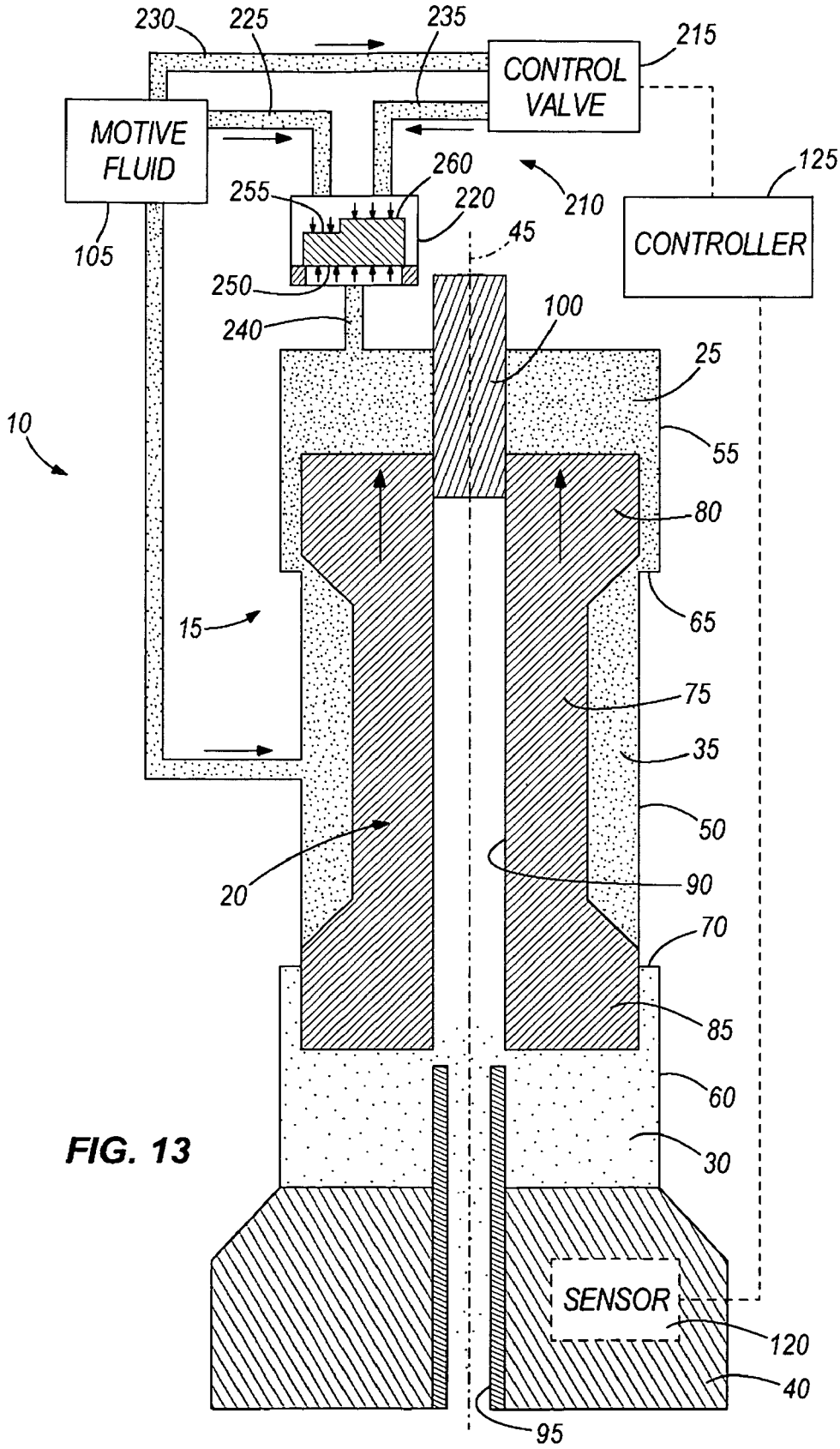
FIGS. 13-14 are a schematic illustration of a third embodiment of the invention operating at a first frequency.
Figure 14:
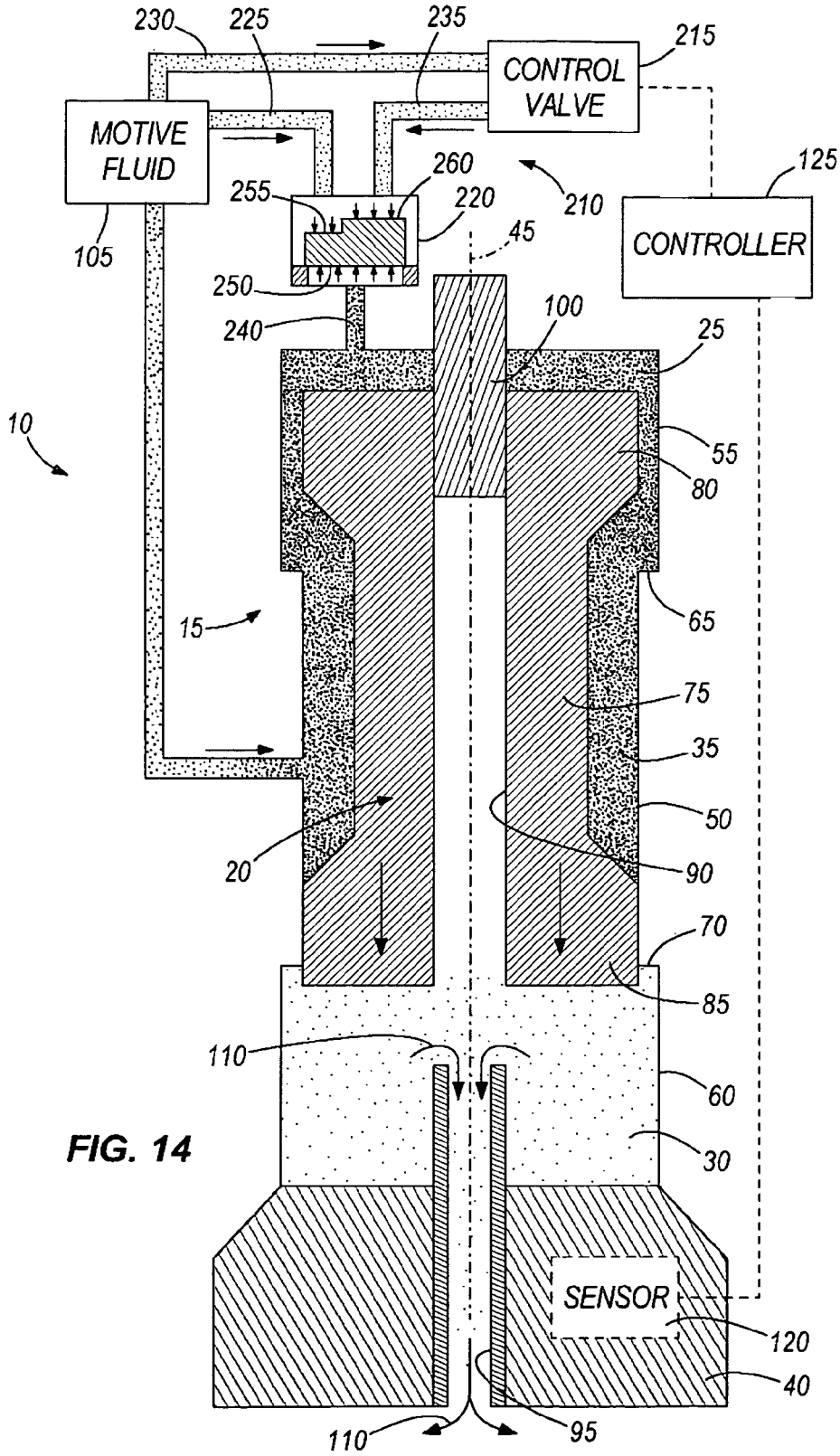

FIGS. 13 and 14 illustrate the drill operating at a first frequency. In these figures, the controller 125 opens the control valve 215 to generate the control signal, which effectively locks the main valve 220 closed. As a result, the drill in FIGS. 13 and 14 operates as described with respect to FIGS. 1-6. FIG. 13 illustrates the supply chamber 35 being placed in communication with the drive chamber 25 to raise pressure in the drive chamber 25, and FIG. 14 illustrates the critical pressure having been achieved in the drive chamber 25 without opening the main valve 220.

Figure 15:
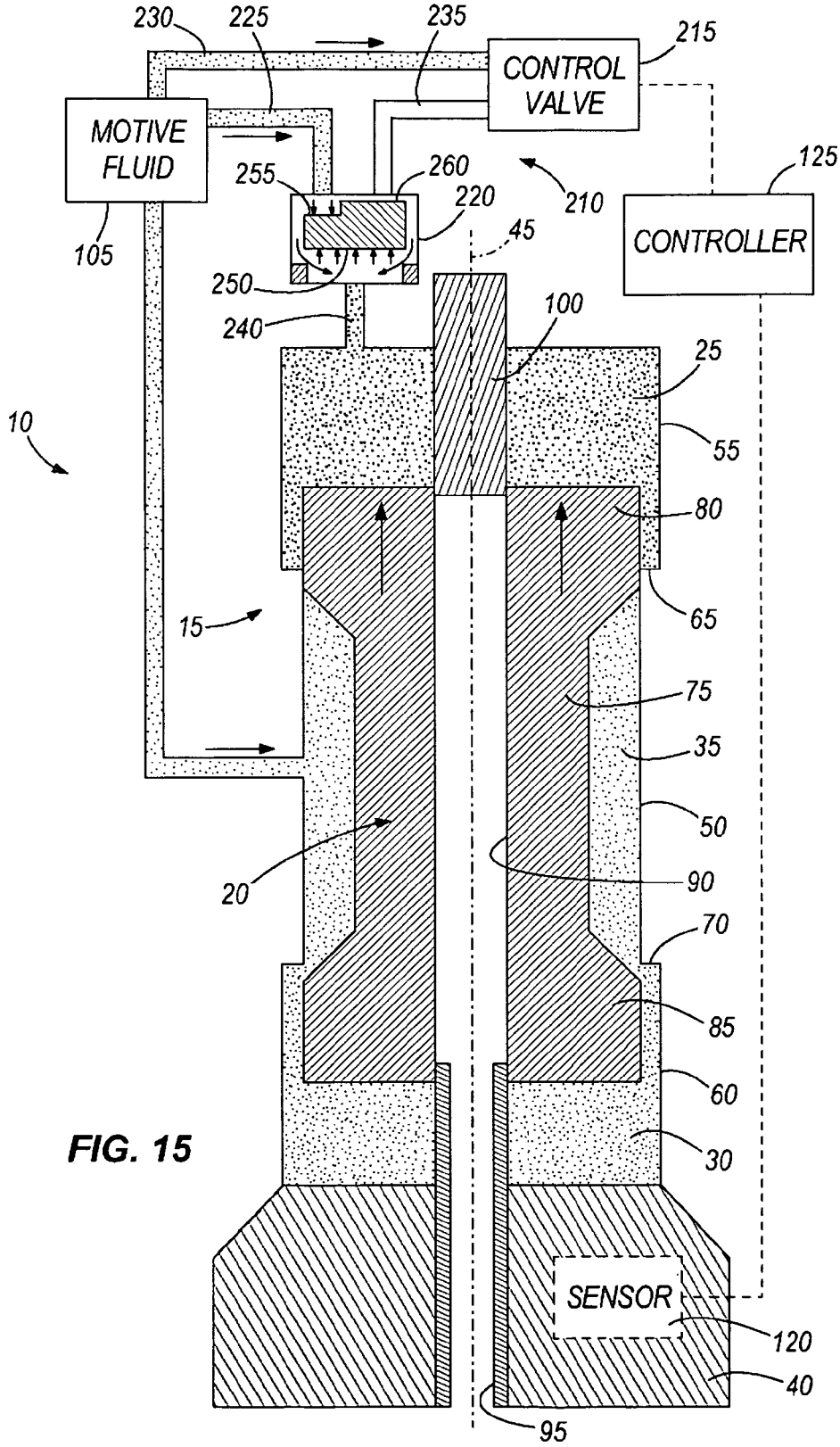
FIGS. 15-16 are a schematic illustration of the third embodiment operating at a second frequency.
Figure 16:
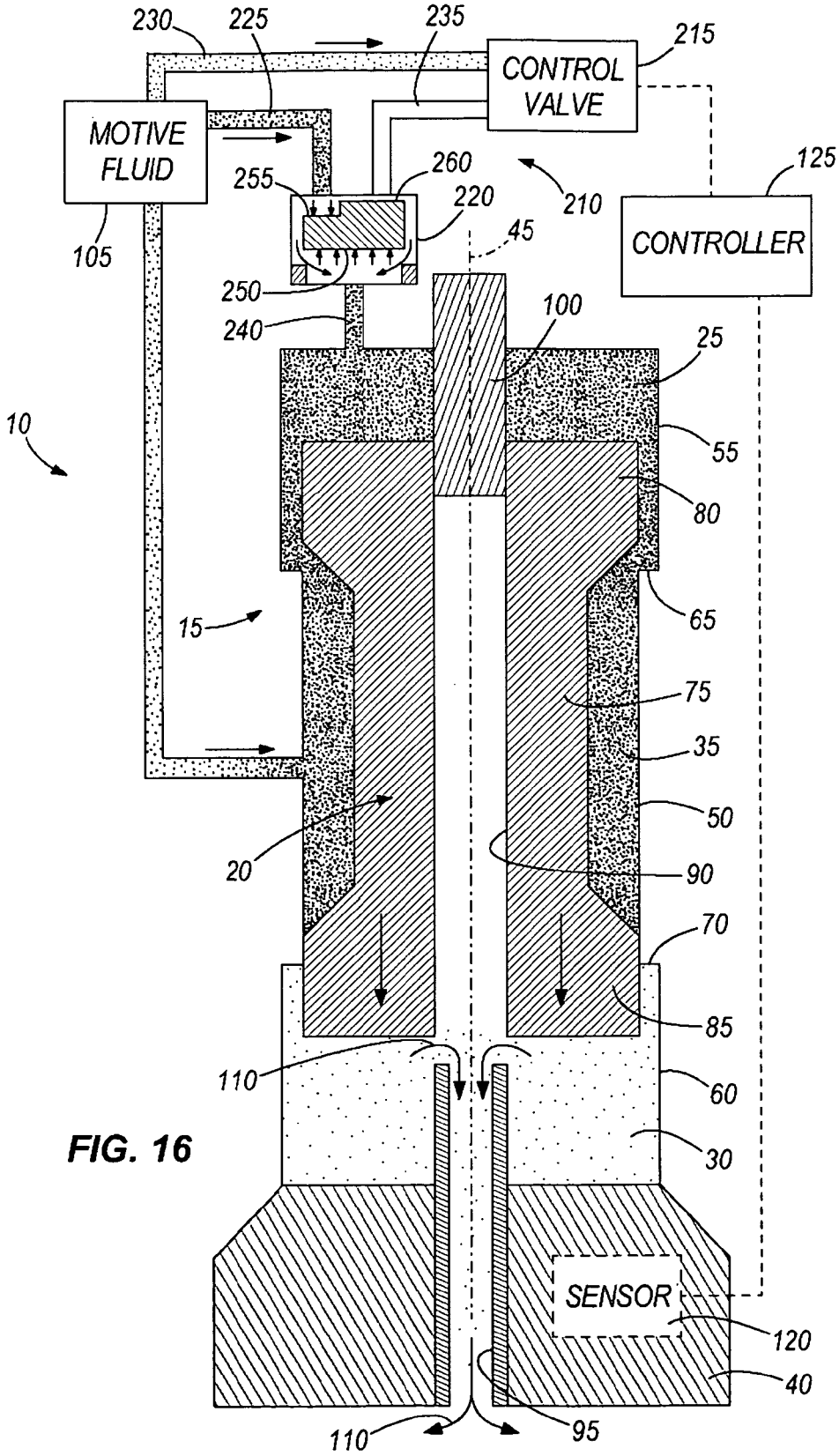
Figure 17:
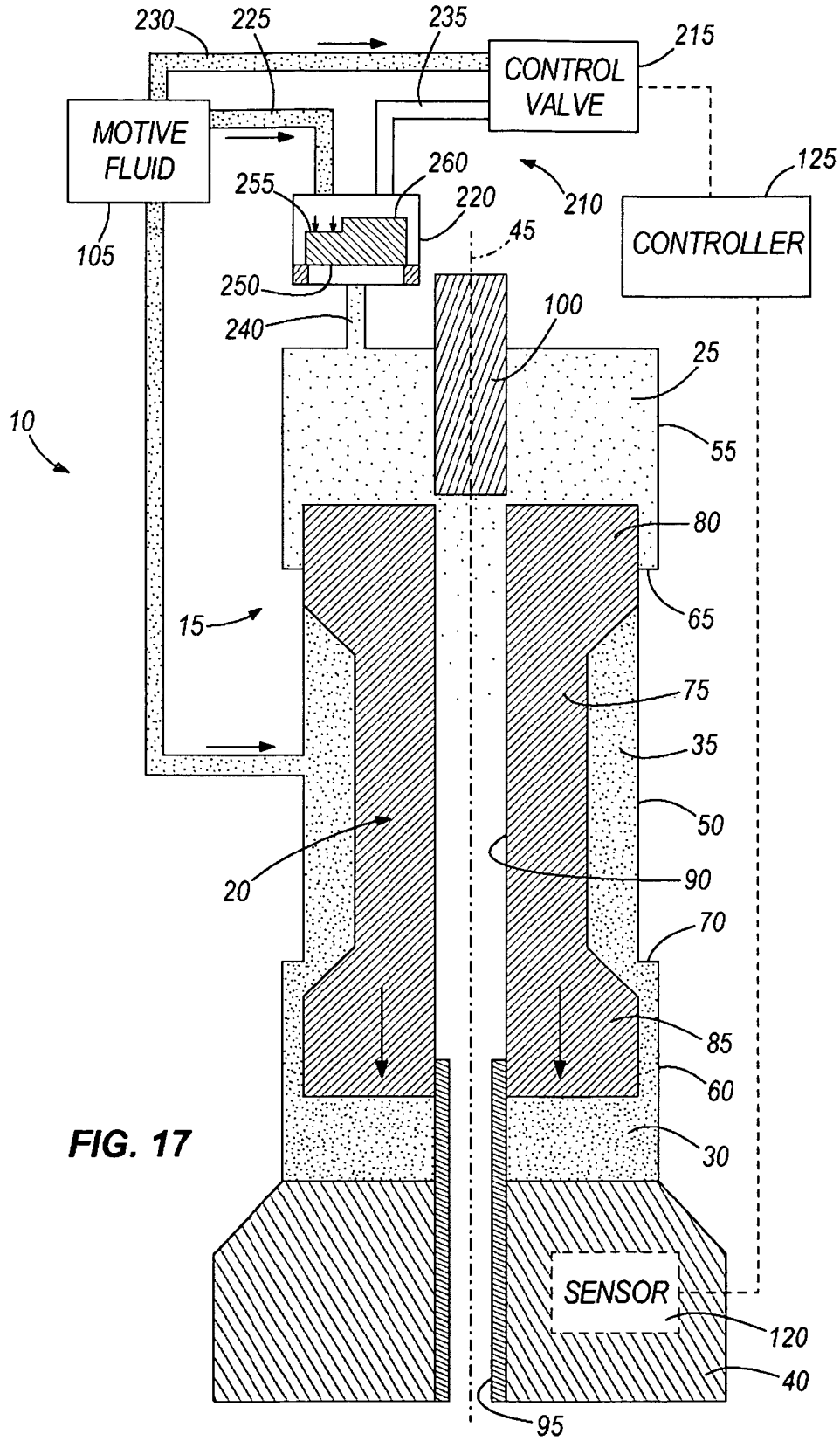
FIG. 17 is a schematic illustration of the third embodiment during a drive stroke portion of the cycle.

FIGS. 15-17 illustrate the drill operating at a second frequency that is higher than the first frequency. In these figures, the controller 125 initially closes the control valve 215 to turn off the control signal. With reference to FIG. 15, the main valve 220 (e.g., the balance of the first, second, and third surface areas 250, 255, 260) is arranged such that pressure in the drive chamber 25 reaches lift off pressure prior to the top 80 of the piston 20 clearing the shoulder 65, the main valve 220 opens, and motive fluid is introduced to the drive chamber 25. With reference to FIG. 16, critical pressure is achieved sooner as a result of the main valve 220 opening than in FIG. 14 in which the main valve 220 is held closed. Consequently, the stroke is shortened and the frequency of the drill is increased when the control valve 215 is closed.

Despite the early introduction of motive fluid to the drive chamber 25, the upward momentum of the piston 20 causes the bottom 85 of the piston 20 to clear the exhaust conduit 95 prior to the critical pressure being reached in the drive chamber 25, and motive fluid in the return chamber 30 is quickly vented as the piston 20 commences the downward stroke. With reference to FIG. 17, pressure in the drive chamber 25 drops below the lift off pressure quickly after the plug 100 is removed from the piston bore 90, which causes the main valve 220 to return to the closed position due to the force arising from supply pressure acting on the second surface area 255 exceeding the force arising from decreased (e.g., substantially atmospheric) pressure acting on the first surface area 250.

Figure 18:
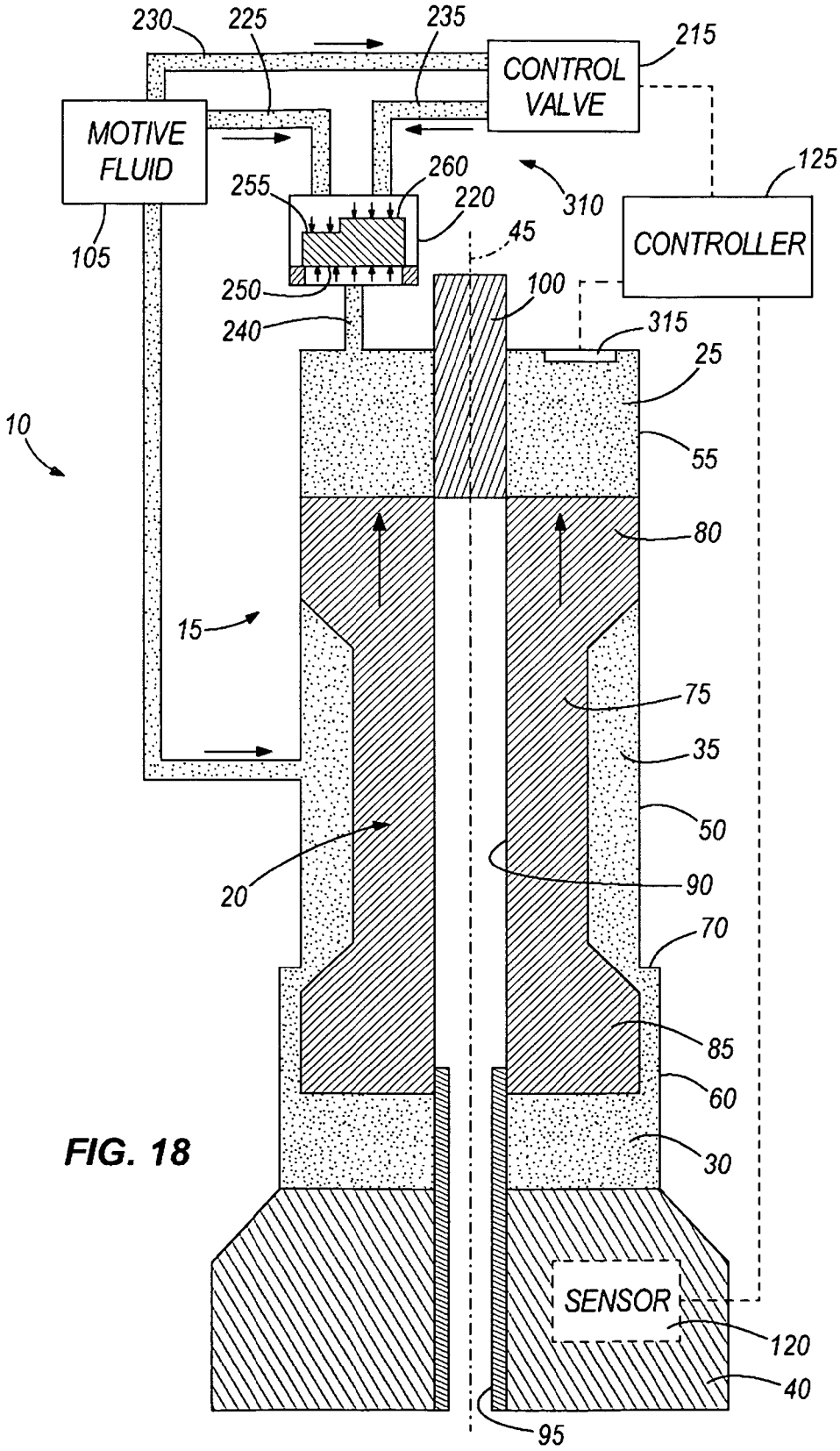
FIG. 18 is a schematic illustration of a fourth embodiment of the invention at a moment in a return stroke in which a drive chamber is sealed.

FIGS. 18-23 illustrate another embodiment 310 of a variable frequency drill control system. In this embodiment, there is no drive shoulder 65, but there is a return shoulder 70. This embodiment also includes a sensor 315 in the drive chamber 25 or on the piston 20 that senses a real-time operating parameter of the drill, such as drive chamber pressure or piston position. FIG. 18 illustrates the point in the return stroke when the plug 100 closes the piston bore 90. The controller 125 has opened the control valve 215 such that the control signal effectively locks the main valve 220 closed. Continued upward movement of the piston 20 from the position illustrated in FIG. 18 causes a rise in pressure in the drive chamber 25 due to the resulting decreasing volume.

Figure 19:
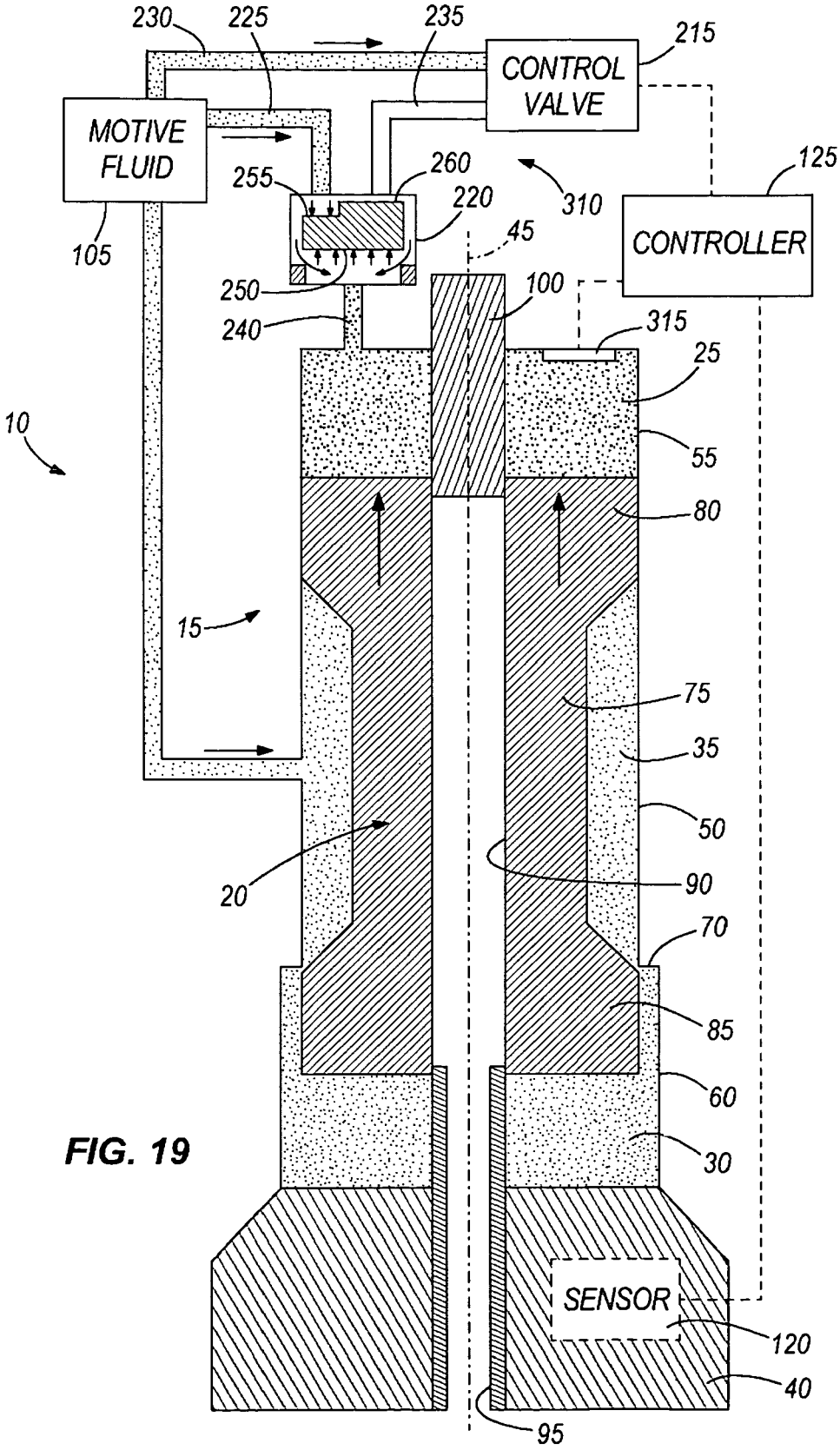
FIGS. 19-20 are a schematic illustration of the fourth embodiment operating at a first frequency.
Figure 20:
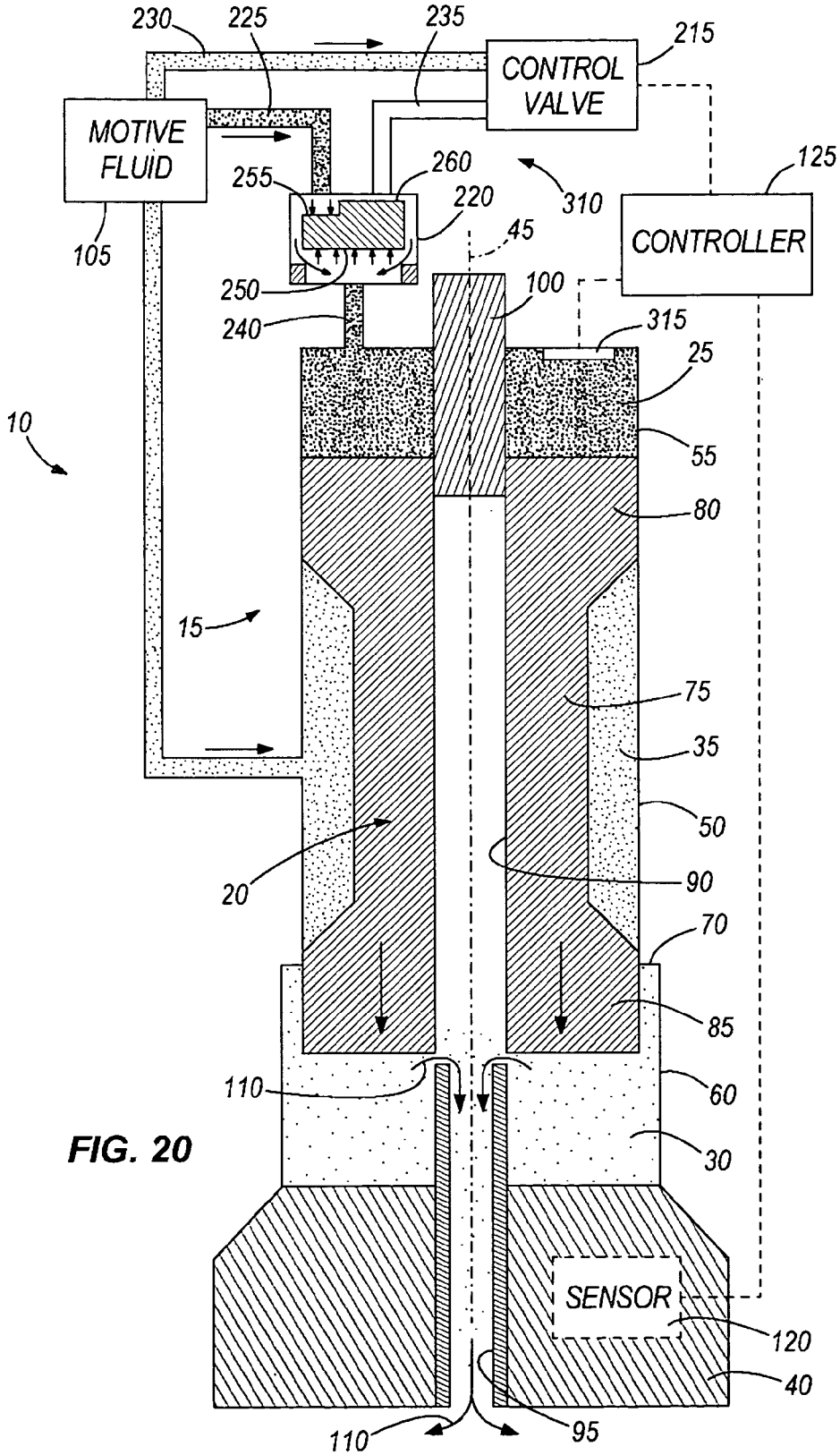

FIGS. 19 and 20 illustrate one extreme of the control system 310 operation in which the controller 125 closes the control valve 215 upon the piston 20 reaching the position illustrated in FIG. 18, such that the main valve 220 is permitted to open upon pressure in the drive chamber 25 reaching lift off pressure. The configuration of the first, second, and third surface areas 250, 255, 260 in the main valve 220 (which in some embodiments may not include surface area 255) will determine the actual lift off pressure for a given main valve 220, but at this extreme of the control system 310 operation, the main valve 220 will open immediately upon the pressure in the drive chamber 25 reaching lift off pressure. Lift off pressure is reached with the piston 20 at the position in FIG. 19, and critical pressure is reached with the piston at the position in FIG. 20. With the control valve 215 closed or off during the entire stroke or closed at the moment the piston reaches the position in FIG. 18, the drill operates at the highest possible frequency for control system 310.

Figure 21:
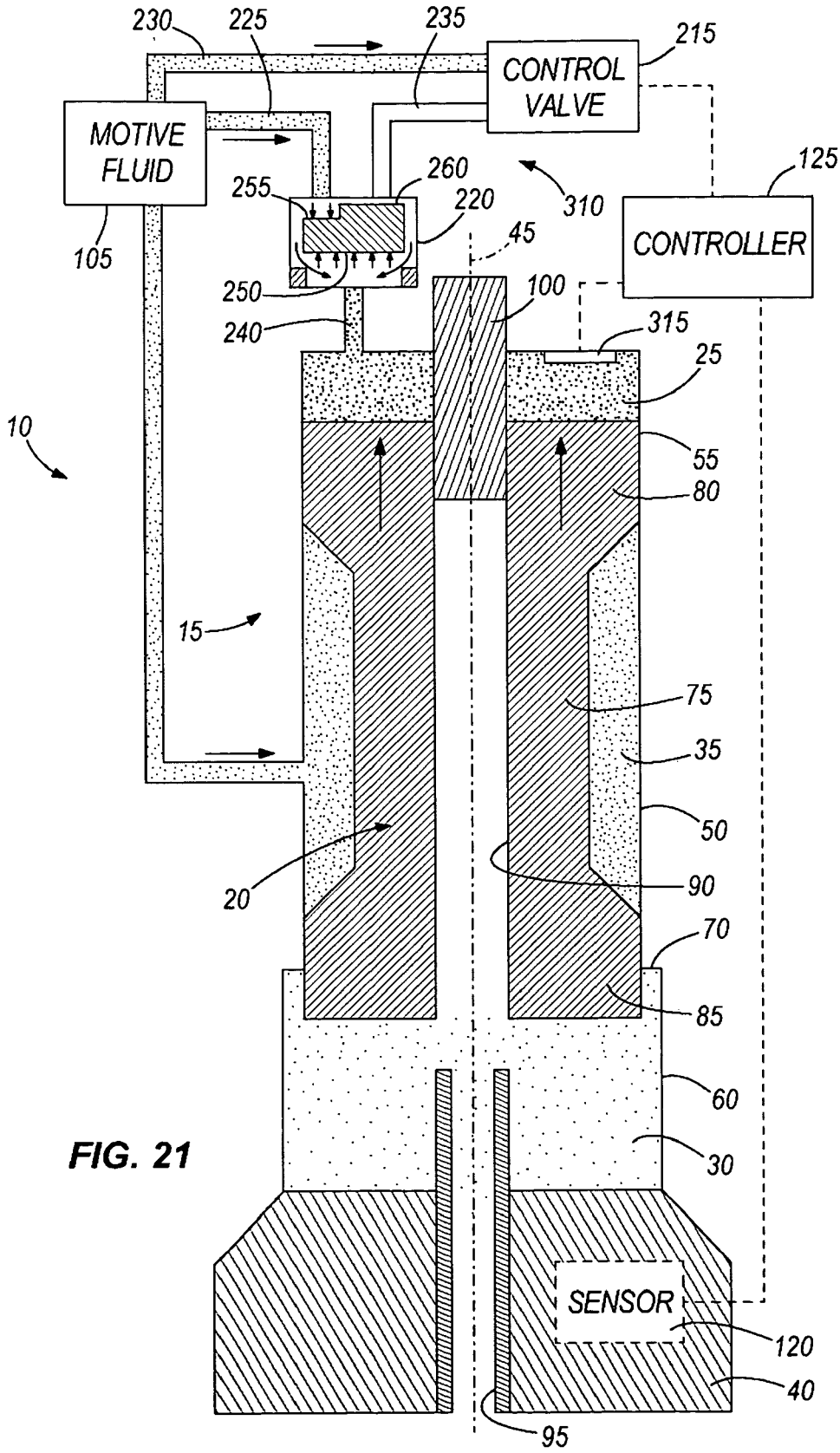
FIGS. 21-22 are a schematic illustration of the fourth embodiment operating at a second frequency.
Figure 22:
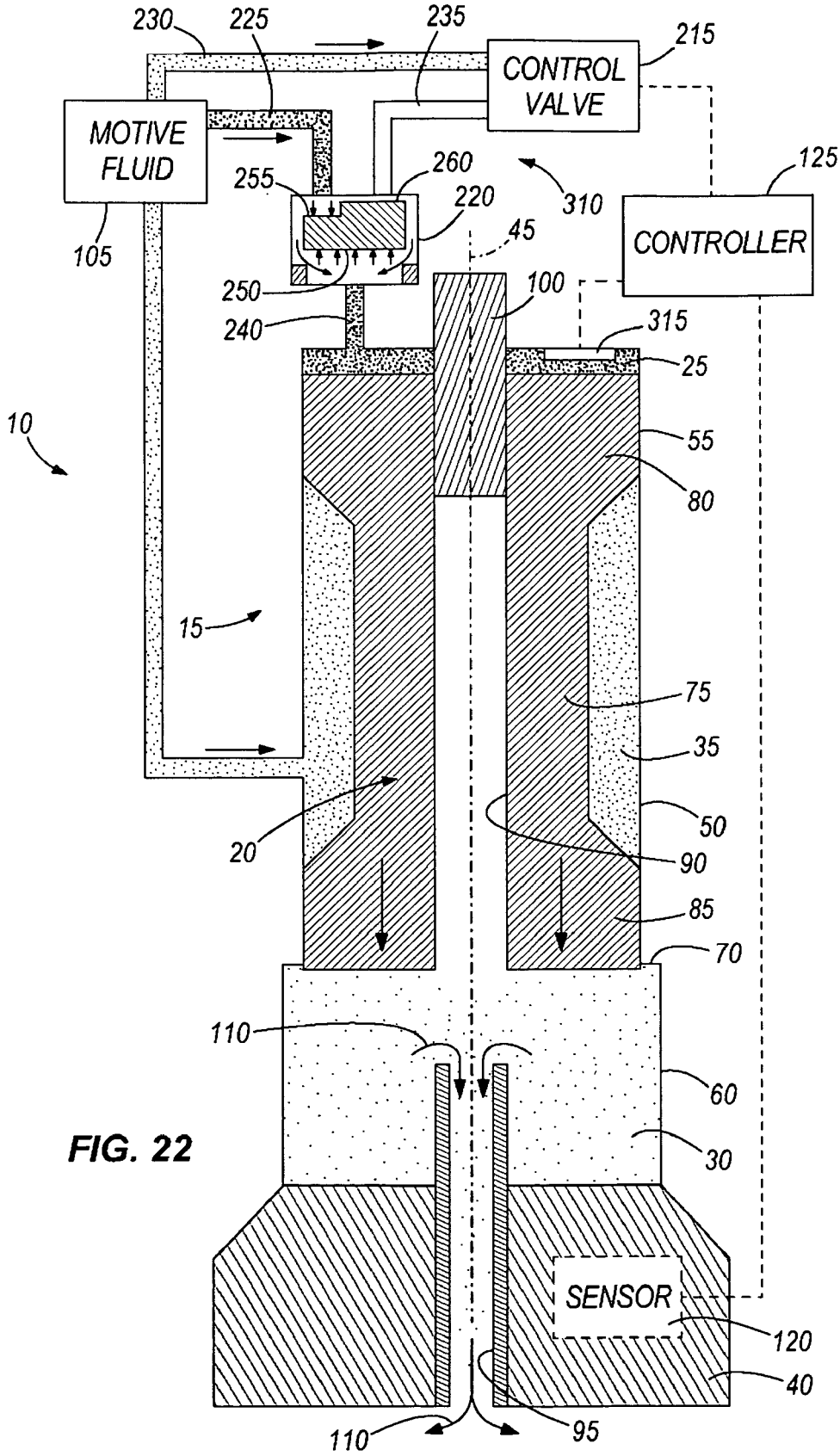

FIGS. 21 and 22 illustrate one of the lowest frequencies at which the drill can operate with the control system 310. In this mode of operation, the controller 125 keeps the control valve 215 open until well after lift off pressure is achieved (i.e., after the piston 20 has risen past the point of FIG. 19). The piston 20 position at which the controller 125 turns off the control valve 215 in this mode of operation is illustrated in FIG. 21. The sensor 315 measures the piston 20 position, drive chamber 25 pressure, or another parameter that indicates to the controller 125 that it is time to close the control valve 215.

Because pressure in the drive chamber 25 exceeds lift off pressure, the main valve 220 opens immediately upon the control signal being shut off in FIG. 21. Because the main valve 220 opens later in this mode of operation, the drive chamber 25 reaches critical pressure later, as illustrated in FIG. 22 (compared to FIG. 20), resulting in the drill operating at a lower frequency.

The controller 125 may be programmed or manually operated in response to the sensor 315 sensing a selected value for a given parameter, such as drive chamber pressure or piston position. Frequencies between those in the two modes of operation described above (FIGS. 19 and 20 in one mode and FIGS. 21 and 22 in another mode) can be achieved by changing the trigger point (which is a function of the parameter sensed by the sensor 315) at which the controller 125 closes the control valve 215. In fact, under the control system 310, the trigger point (and resultant frequency) is substantially infinitely adjustable. The control system 310 may be set up to operate the drill at many different frequencies, not just two as discussed above with other embodiments. As a result, instead of or in addition to the drill operating alternatingly in a sequence of first and second frequencies to convey information to the surface, the frequency of drill operation itself may convey messages (e.g., operation at a first frequency informs a receiver at the surface of a first type of information, operation at a second frequency informs the receiver of a second type of information, etc.).

Figure 23:
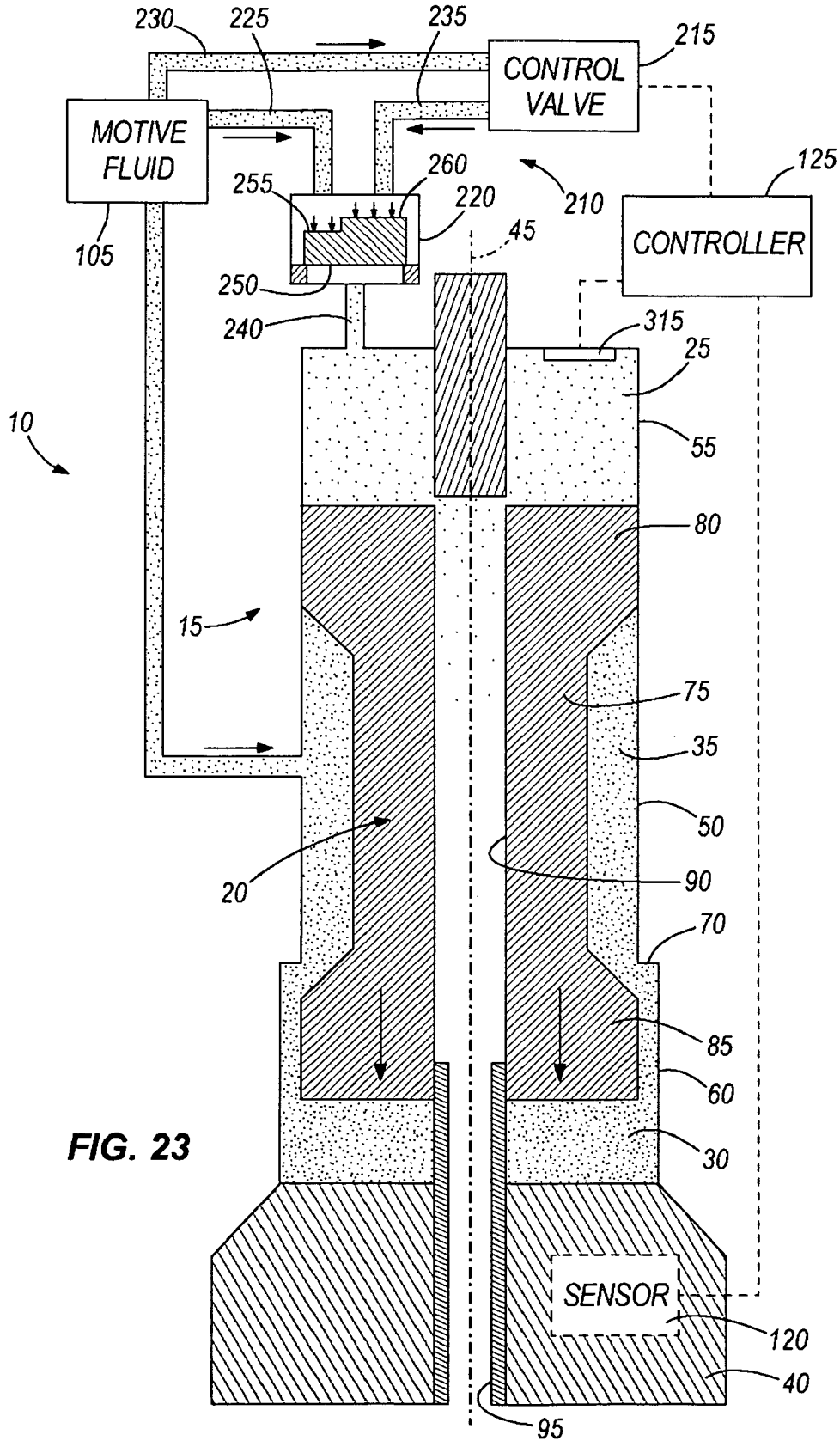
FIG. 23 is a schematic illustration of the fourth embodiment during a drive stroke portion of the cycle.

With reference to FIG. 23, regardless of the control strategy employed, the downward stroke is substantially the same. When the plug 100 is removed from the piston bore 90, the pressure in the drive chamber 25 drops as motive fluid is exhausted, and at the same time the main valve 220 closes if it was opened, due to the drop in pressure in the drive chamber 25. The controller 125 may even open the control valve 215 at this time or earlier to assist in closing the main valve 220. The bottom 85 of the piston 20 clears the return shoulder 70 such that the supply chamber 35 communicates with the return chamber 30, and motive fluid floods into the return chamber 30 to assist in the return stroke of the piston 20.

Thus, the invention provides, among other things, a variable frequency down hole drill having the capability of changing frequency of the drill during continuous operation of the drill. Various features and advantages of the invention are set forth in the following claims.

What is claimed is:

1. A variable frequency down hole drill, comprising:

a supply of motive fluid in the form of a compressible fluid;

an exhaust structure communicating with the atmosphere;

a drill bit;

a reciprocating piston supported for reciprocation with respect to the drill bit;

a drive chamber above the piston;

a return chamber below the piston;

means for driving reciprocation of the piston by alternatingly placing the drive chamber in communication with the supply of motive fluid and the return chamber in communication with the exhaust structure in a first instance and placing the drive chamber in communication with the exhaust structure and the return chamber in communication with the supply of motive fluid in a second instance;

means for generating a command signal; and means for changing, in response to the command signal, the frequency with which the piston delivers impact loading to the drill bit;

wherein the drill bit, piston, drive chamber, return chamber, and means for driving reciprocation comprise a drilling assembly adapted for operation at the bottom of a hole being drilled; and wherein the means for generating a command signal and the means for changing the frequency physically reside on the drilling assembly and are functional while the drilling assembly is down the hole.

2. The variable frequency down hole drill of claim 1, wherein the means for changing frequency includes means for changing frequency during continuous operation of the drill.

3. The variable frequency down hole drill of claim 1, wherein the means for changing the frequency includes a supplemental volume chamber and a valve operable between an open position in which the valve places the drive chamber in communication with the supplemental volume chamber, and a closed condition in which the valve cuts off communication between the supplemental volume chamber and the drive chamber.

4. The variable frequency down hole drill of claim 1, wherein the means for changing the frequency includes a supplemental volume chamber and a valve operable between an open position in which the valve places the return chamber in communication with the supplemental volume chamber, and a closed condition in which the valve cuts off communication between the supplemental volume chamber and the return chamber.

5. The variable frequency down hole drill of claim 1, wherein the means for changing the frequency includes means for changing the timing of placing the drive chamber in communication with the exhaust structure.

6. The variable frequency down hole drill of claim 1, wherein the means for changing the frequency includes means for changing the timing of placing the drive chamber in communication with the supply of motive fluid.

7. The variable frequency down hole drill of claim 1, wherein the means for changing the frequency includes means for changing the timing of placing the return chamber in communication with the exhaust structure.

8. The variable frequency down hole drill of claim 1, wherein the means for changing the frequency includes means for changing the timing of placing the return chamber in communication with the supply of motive fluid.

9. The variable frequency down hole drill of claim 1, further comprising a control system for sensing an operating parameter of the drill and actuating the means for changing the frequency in response to sensing a predetermined operating parameter.

10. The variable frequency down hole drill of claim 9, wherein the control system includes a controller and a sensor sensing one of pressure and piston position.

11. The variable frequency down hole drill of claim 9, wherein the control system includes a controller, a control valve, and a main valve; wherein the main valve opens in response to a lift off pressure being achieved in the drive chamber to place the drive chamber in communication with the supply of motive fluid; and wherein the controller opens the control valve to generate a control signal from the control valve to the main valve to delay opening of the main valve after lift off pressure is achieved, to alter the timing of opening of the main valve.

12. A variable frequency down hole drill for use with a supply of motive fluid in the form of a compressible fluid, the variable frequency down hole drill comprising:

an exhaust structure communicating with the atmosphere;

a drill bit;

a reciprocating piston supported for reciprocation with respect to the drill bit;

a drive chamber above the piston;

a return chamber below the piston;

a valve adapted to place the drive chamber and return chamber in alternating communication with the supply of motive fluid and exhaust structure to drive reciprocation of the piston; and a mechanism for changing the timing of operation of the valve in response to a command signal, to change the frequency with which the piston delivers impact loading to the drill bit;

wherein the drill bit, piston, drive chamber, return chamber, and valve comprise a drilling assembly adapted to be positioned at the bottom of a hole being drilled for operation down the hole; and wherein the mechanism for changing timing of operation physically resides on the drilling assembly and is functional while the drilling assembly is down the hole.

13. The variable frequency down hole drill of claim 12, wherein the mechanism for changing timing of operation of the valve is operable during continuous operation of the drill.

14. The variable frequency down hole drill of claim 12, wherein the mechanism for changing timing of operation of the valve includes a second valve operable to open and close communication between one of the drive and return chambers and a supplemental volume chamber.

15. The variable frequency down hole drill of claim 12, wherein the mechanism for changing timing of operation of the valve includes a mechanism for changing the timing of placing at least one of the drive chamber and return chamber in communication with at least one of the supply of motive fluid and the exhaust structure.

16. The variable frequency down hole drill of claim 12, wherein the mechanism for changing timing of operation of the valve includes a sensor monitoring an operating parameter of the drill and generating the command signal in response to sensing a predetermined value for the operating parameter.

17. The variable frequency down hole drill of claim 12, wherein the mechanism for changing timing of operation of the valve includes a controller, a control valve, and a main valve; wherein the main valve opens in response to a lift off pressure being achieved in the drive chamber to place the drive chamber in communication with the supply of motive fluid; and wherein the controller opens the control valve to generate a control signal from the control valve to the main valve to delay opening of the main valve after lift off pressure is achieved, to alter the timing of opening of the main valve.

18. A method for operating a down hole drill at variable speeds under the influence of motive fluid in the form of a compressible fluid, the method comprising:

(a) providing a drilling assembly comprising a drill bit, a piston, a drive chamber, a return chamber, and a valve, the drilling assembly being adapted to be positioned at the bottom of a hole being drilled for operation down the hole;

(b) physically positioning on the drilling assembly a mechanism for changing a frequency at which the piston reciprocates, such that the mechanism is operable on the drilling assembly down the hole;

(c) driving reciprocation of the piston by alternatingly establishing and cutting off communication between a supply of motive fluid and exhaust and the drive and return chambers;

(d) exhausting the motive fluid to atmosphere after driving reciprocation;

(e) impacting the drill bit with the piston once per cycle of operation of the piston; and (f) during continuous operation of the drill and while the drilling assembly and mechanism for changing frequency are down the hole, operating the mechanism for changing frequency to change a timing at which communication between at least one of the drive chamber and return chamber and at least one of the supply of motive fluid and the exhaust is established and cut off.

19. The method of claim 18, wherein step (c) includes sensing an operating parameter of the drill during continuous operation of the drill, automatically generating a command signal in response to the operating parameter meeting a predetermined value, and, in response to generation of the command signal, actuating a mechanism for altering the timing of communication between at least one of the opposite ends of the piston and at least one of the supply of motive fluid and exhaust.

* * * * *